US007049749B2

(12) United States Patent
Horiuchi et al.

(10) Patent No.: US 7,049,749 B2
(45) Date of Patent: May 23, 2006

(54) DISCHARGE LAMP, METHOD FOR PRODUCING THE SAME AND LAMP UNIT

(75) Inventors: Makoto Horiuchi, Nara (JP); Makoto Kai, Osaka (JP); Tomoyuki Seki, Osaka (JP); Tsuyoshi Ichibakase, Osaka (JP); Mamoru Takeda, Kyoto (JP); Shinichi Yamamoto, Osaka (JP); Kenichi Sasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/078,856

(22) Filed: Mar. 11, 2005

(65) Prior Publication Data

US 2005/0156526 A1 Jul. 21, 2005

Related U.S. Application Data

(63) Continuation of application No. 09/824,505, filed on Apr. 2, 2001, now Pat. No. 6,897,612.

(30) Foreign Application Priority Data

Apr. 3, 2000 (JP) ..... 2000-100662

(51) Int. Cl.
*H01J 17/18* (2006.01)
*H01J 61/36* (2006.01)

(52) U.S. Cl. ..... 313/623; 313/624; 313/625

(58) Field of Classification Search ..... 313/623–625
See application file for complete search history.

(56) References Cited

U.S. PATENT DOCUMENTS

| | | | |
|---|---|---|---|
| 2,667,595 | A | 1/1954 | Noel et al. |
| 4,110,657 | A | 8/1978 | Sobieski |
| 4,254,356 | A | 3/1981 | Karikas |
| 4,700,107 | A | 10/1987 | Fischer |
| 4,849,669 | A | 7/1989 | Ooms |
| 5,128,588 | A | 7/1992 | Kameya et al. |
| 5,159,239 | A | 10/1992 | Ekkelboom et al. |
| 5,200,669 | A | 4/1993 | Dixon et al. |
| 5,241,239 | A | 8/1993 | Rao |
| 5,387,840 | A | 2/1995 | Noteleteirs et al. |
| 5,430,353 | A | 7/1995 | Feldman et al. |
| 5,453,654 | A | 9/1995 | Bastian et al. |
| 5,527,199 | A | 6/1996 | Feder et al. |
| 5,896,004 | A | 4/1999 | Feldman et al. |
| 5,936,349 | A | 8/1999 | Fukai et al. |

FOREIGN PATENT DOCUMENTS

| | | |
|---|---|---|
| EP | 0 550 878 A1 | 7/1993 |
| EP | 0 579 313 A1 | 1/1994 |
| EP | 0 866 488 A1 | 9/1998 |
| EP | 0 903 771 A2 | 3/1999 |
| JP | 56-165358 | 5/1955 |
| JP | 55-143767 | 11/1980 |
| JP | 58-110961 | 7/1983 |

(Continued)

*Primary Examiner*—Mariceli Santiago
*Assistant Examiner*—Anthony Perry
(74) *Attorney, Agent, or Firm*—Harness, Dickey & Pierce, P.L.C.

(57) ABSTRACT

A discharge lamp includes a luminous bulb in which a luminous material is enclosed and a pair of electrodes are opposed in the luminous bulb; and a pair of sealing portions for sealing a pair of metal foils electrically connected to the pair of electrodes, respectively. At least one of the pair of metal foils has a twist structure.

5 Claims, 20 Drawing Sheets

FOREIGN PATENT DOCUMENTS

| | | | | |
|---|---|---|---|---|
| JP | 61-138446 | | | 6/1986 |
| JP | 03184254 | A | | 8/1991 |
| JP | 05217555 | A | | 8/1993 |
| JP | 05234571 | A | | 9/1993 |
| JP | 06016300 | A | | 1/1994 |
| JP | 6-163000 | | | 6/1994 |
| JP | 07192704 | A | | 7/1995 |
| JP | 10112262 | | | 4/1998 |
| JP | 10255720 | A | | 9/1998 |
| JP | 11067093 | A | | 3/1999 |
| JP | 11317198 | A | * | 11/1999 |
| JP | 2000-173543 | | | 6/2000 |
| JP | 2001-023565 | | | 1/2001 |

* cited by examiner

DISCHARGE LAMP, METHOD FOR PRODUCING THE SAME AND LAMP UNIT

BACKGROUND OF THE INVENTION

The present invention relates to a discharge lamp and a lamp unit. In particular, a discharge lamp and a lamp unit used as a light source for an image projection apparatus such as a liquid crystal projector and a digital micromirror device (DMD) projector.

In recent years, an image projection apparatus such as a liquid crystal projector and a DMD projector has been widely used as a system for realizing large-scale screen images, and a high-pressure discharge lamp having a high intensity has been commonly and widely used in such an image projection apparatus. In the image projection apparatus, light is required to be concentrated on a very small area of a liquid crystal panel or the like, so that in addition to high intensity, it is also necessary to achieve nearly a point light source. Therefore, among high-pressure discharge lamps, a short arc type ultra high pressure mercury lamp that is nearly a point light and has a high intensity has been noted widely as a promising light source.

Referring to FIGS. 21A to 21C, a conventional short arc type ultra high pressure mercury lamp 1000 will be described.

FIG. 21A is a schematic top view of a lamp 1000. FIG. 21B is a schematic side view of a lamp 1000. FIG. 21C is a cross-sectional view taken along line c–c' of FIG. 21A.

The lamp 1000 includes a substantially spherical luminous bulb 110 made of quartz glass, and a pair of sealing portions 120 and 120' (seal portions) made of also quartz glass and connected to the luminous bulb 110. A discharge space 115 is inside the luminous bulb 110. A mercury 118 in an amount of the enclosed mercury of, for example, 150 to 250 mg/cm$^3$ as a luminous material, a rare gas (e.g., argon with several tens kPa) and a small amount of halogen are-enclosed in the discharge space 115.

A pair of tungsten electrodes (W electrode) 112 and 112' are opposed with a certain gap in the discharge space 115, and a coil 114 is wound around the end of the electrode 112 (or 112'). An electrode axis 116 of the electrode 112 is welded to a molybdenum foil (Mo foil) 124 in the sealing portion 120, and the W electrode 112 and the Mo foil 124 are electrically connected by a welded portion 117 where the electrode axis 116 and the Mo foil 124 are welded.

The sealing portion 120 includes a glass portion 122 extended from the luminous bulb 110 and the Mo foil 124. The glass portion 122 and the Mo foil 124 are attached tightly so that the airtightness in the discharge space 115 in the luminous bulb 110 is maintained. The principle on the reason why the luminous bulb 110 can be sealed by the sealing portion 120 will be briefly described below.

Since the thermal expansion coefficient of the quartz glass constituting the glass portion 122 is different from that of the molybdenum constituting the Mo foil 124, the glass portion 122 and the Mo foil 124 are not integrated. However, by plastically deforming the Mo foil 124, the gap between the Mo foil 124 and the glass portion 122 can be filled. Thus, the Mo foil 124 and the glass portion 122 are pressed and attached to each other, and the luminous bulb 110 can be sealed with the sealing portion 120. In other words, the sealing portion 120 is sealed by attaching the Mo foil 124 and the glass portion 122 tightly for foil-sealing.

The Mo foils 124 of the sealing portions 120 and 120' have the same size and a rectangular plane shape, and are positioned at the center of the internal portion of the respective sealing portions 120 and 120' so that the directions x (width directions) perpendicular to the thickness directions Z of the foils are in the same direction. In other words, the pair of the sealing portions 120 and 120' is coupled to the ends of the luminous bulb 110 so that the flat Mo foils 124 are symmetrical with respect to the luminous bulb 110 as the center.

The Mo foil 124 includes an external lead (Mo rod) 130 made of molybdenum on the side opposite to the side on which the welded portion 117 is positioned. The Mo foil 124 and the external lead 130 are welded with each other so that the Mo foil 124 and the external lead 130 are electrically connected at a welded portion 132. The external lead is electrically connected to a member (not shown) positioned in the periphery of the lamp 1000.

Next, the operational principle of the lamp 1000 will be described. When a start voltage is applied to the W electrodes 112 and 112' via the external leads 130 and the Mo foils 124, discharge of argon (Ar) occurs. Then, this discharge raises the temperature in the discharge space 115 of the luminous bulb 110, and thus the mercury 118 is heated and evaporated. Thereafter, mercury atoms are excited and become luminous in the arc center between the W electrodes 112 and 112'. As the pressure of the mercury vapor of the lamp 1000 is higher, the emission efficiency is higher, so that the higher pressure of the mercury vapor is suitable as a light source for an image projection apparatus. However, in view of the physical strength against pressure of the luminous bulb 110, the lamp 1000 is used at a mercury vapor pressure of 15 to 25 MPa.

As a result of in-depth research, the inventors of the present invention found that the lifetime of the conventional lamp 1000 is shortened by leaks occurring in the sealing portions 120. More specifically, the sealing portions 120 of the lamp 1000 are sealed by attaching the Mo foils 124 and the glass portions 122 tightly, so that as shown in FIGS. 22A and 22B, an internal stress 40 occurs in the direction perpendicular to the surface of the foil (the Z direction in FIGS. 22A and 22B) on the Mo foil 124. Therefore, when the glass portions 122 are deteriorated with use of the lamp 1000 and the strength of the glass portions 112 is reduced, the glass portions 112 can be split by the internal stress 40 on the Mo foils 124 at a certain point. When the glass portions are split, air is let into the sealing portions 120 so that the Mo foils 124 are oxidized. Thus, the conductivity of the Mo foils 124 is lost, so that the lamp 1000 stops its operation.

Furthermore, in the welded portions 132 in the sealing portions 120, the Mo foils 124 and the external leads 130 are substantially in point contact with each other, so that the contact area therebetween is small. Therefore, a local increase in the temperature is often caused by current flowing from the external leads 130 to the Mo foils 124. Molybdenum constituting the Mo foils 124 has the nature that it is oxidized at 350° C. or more, so that this local increase in the temperature causes a large problem when the Mo foils 124 are used. There may be an approach of suppressing the local increase in the temperature of the welded portion 132 by increasing the size of the Mo foils 124 to increase the heat capacity. However, it is difficult to adopt this approach in the context that there is a great demand for compactness of the lamp size with a trend of compactness of image projection apparatuses. Furthermore, to achieve high intensity, there is a tendency of reducing the electrode distance L between the W electrodes 112 and 112' (to achieve a short arc) to allow a large amount of current to flow. Therefore, the problem of the local increase in the temperature of the welded portions 132 may become more serious. Furthermore, even if the oxidation of the Mo foils 124 does not occur, the local increase in the temperature of the welded portions 132 may generate a starting point of cracks in the glass in the periphery of the welded portions 132. Therefore, the temperature increase is problematic also in view of a cause of leaks of the sealing portions 120.

SUMMARY OF THE INVENTION

Therefore, with the foregoing in mind, it is a main object of the present invention to provide a discharge lamp having a long lifetime in which the sealing structure of the sealing portions can be maintained for a long period. It is another object of the present invention to provide a discharge lamp having a long lifetime in which a local increase in the temperature is prevented.

A discharge lamp of the present invention includes a luminous bulb in which aluminous material is enclosed and a pair of electrodes are opposed in the luminous bulb; and a pair of sealing portions for sealing a pair of metal foils electrically connected to the pair of electrodes, respectively; wherein at least one of the pair of metal foils has a twist structure. This structure can solve the above problems.

It is preferable that the metal foil having a twist structure has a 90° twisted portion.

According to another aspect of the present invention, a discharge lamp includes a luminous bulb in which a luminous material is enclosed and a pair of electrodes are opposed in the luminous bulb; and a pair of sealing portions for sealing a pair of metal foils electrically connected to the pair of electrodes, respectively; wherein each of the pair of metal foils has an external lead on a side opposite to a side electrically connected to a corresponding electrode of the pair of electrodes, at least one of the pair of metal foils has a corrugated structure in which the metal foils are corrugated along a longitudinal direction of the metal foils, and the metal foil having the corrugated structure has at least one wave portion in an area between an end of the electrode and an end of the external lead of the metal foil.

It is preferable that at least one wave crest of the wave portion is provided in an area on the luminous bulb side from a midpoint of the metal foil in the longitudinal direction of the metal foil (including the midpoint).

It is preferable that a plurality of wave crests of the wave portion are provided in an area between the end of the electrode and the end of the external lead of the metal foil.

According to another aspect of the present invention, a discharge lamp includes a luminous bulb in which a luminous material is enclosed and a pair of electrodes are opposed in the luminous bulb; and a pair of sealing portions for sealing a pair of metal foils electrically connected to the pair of electrodes, respectively; wherein a first direction perpendicular to a thickness direction of one metal foil of the pair of metal foils is different from a second direction perpendicular to a thickness direction of the other metal foil.

In one embodiment of the present invention, the first direction and the second direction are dislocated by 1° to 90°.

In another embodiment of the present invention, at least one of the pair of metal foils has a twist structure.

In still another embodiment of the present invention, at least one of the pair of metal foils has a corrugated structure.

In yet another embodiment of the present invention, the metal foil having a corrugated structure has at least one bend portion for dispersing directions of internal stresses of the metal foil in the sealing portion.

According to another aspect of the present invention, a discharge lamp includes a luminous bulb in which a luminous material is enclosed and a pair of electrodes are opposed in the luminous bulb; and a pair of sealing portions for sealing a pair of metal foils electrically connected to the pair of electrodes, respectively; wherein each of the pair of metal foils has an external lead on a side opposite to a side electrically connected to a corresponding electrode of the pair of electrodes, and in at least one of the pair of metal foils, an area of the metal foil projected from the luminous bulb side to the external lead side is larger than an area of an end face of the metal foil.

In one embodiment of the present invention, each of the pair of metal foils is tightly attached to a glass portion extending from the luminous bulb, and each of the pair of metal foils is a molybdenum foil.

According to another aspect of the present invention, a discharge lamp includes a luminous bulb in which a luminous material is enclosed and a pair of electrodes are opposed in the luminous bulb; and a pair of sealing portions for sealing a pair of molybdenum foils electrically connected to the pair of electrodes, respectively; wherein each of the pair of molybdenum foils has an external lead made of molybdenum on a side opposite to a side electrically connected to a corresponding electrode of the pair of electrodes, and at least one of the pair of molybdenum foils is integrally formed with the external lead.

According to another aspect of the present invention, a discharge lamp includes a luminous bulb in which a luminous material is enclosed and a pair of electrodes are opposed in the luminous bulb; and a pair of sealing portions for sealing a pair of molybdenum foils electrically connected to the pair of electrodes, respectively; wherein each of the pair of molybdenum foils has an external lead made of molybdenum on a side opposite to a side electrically connected to a corresponding electrode of the pair of electrodes, and at least one of the pair of molybdenum foils is plane-welded to the external lead in which a portion to be connected to the molybdenum foil is plane-shaped.

According to another aspect of the present invention, a discharge lamp includes a luminous bulb in which a luminous material is enclosed and a pair of electrodes are opposed in the luminous bulb; and a pair of sealing portions for sealing a pair of molybdenum foils electrically connected to the pair of electrodes, respectively; wherein at least one of the pair of molybdenum foils has a molybdenum rod extending from the molybdenum foil to the luminous bulb, and the molybdenum rod is connected to either one of the pair of electrodes by welding.

In one embodiment of the present invention, each of the pair of sealing portion has a shrink seal structure.

In another embodiment of the present invention, the luminous material comprises at least mercury.

According to another aspect of the present invention, a lamp unit of the present invention includes the discharge lamp of the present invention and a reflecting mirror for reflecting light emitted from the discharge lamp.

According to another aspect of the present invention, a method for producing a discharge lamp comprising the steps of: (a) preparing a pipe for a discharge lamp including a luminous bulb portion and a side tube portion extending from the luminous bulb portion; and an electrode assembly including a metal foil, an electrode connected to the metal foil, and an external lead connected to the metal foil on a side opposite to a side connected to the electrode; (b) inserting the electrode assembly into the side tube portion so that an end of the electrode is positioned inside the luminous bulb portion; (c) attaching the side tube portion to the metal foil by reducing,a pressure in the pipe for a discharge lamp and heating and softening the side tube portion after the step (b); and (d) forming a twist structure or a corrugated structure in the metal foil by applying an external force to the metal foil after the step (b).

In one embodiment of the present invention, after the side tube portion and the metal foil are attached in the step (c), the step (d) is performed in a state where a part of the attached side tube portion is heated and softened.

In another embodiment of the present invention, the step (d) is performed in a state where a part of the side tube portion and a part of the metal foil are attached by the step (c), and thereafter the step (c) is performed again.

In still another embodiment of the present invention, in the step (a), the electrode assembly is prepared in which the metal foil is a molybdenum foil, and a molybdenum tape for fixing the electrode assembly in the side tube portion is provided in a part of the external lead. In the step (b), the molybdenum tape is engaged in an inner surface of the side tube portion so that the end of the electrode is positioned in the luminous bulb portion. In the step (c), the side tube portion and the metal foil are attached while rotating the pipe for a discharge lamp. In the step (d), the twist structure or the corrugated structure is formed in the metal foil by making a difference in a rotation speed of the pipe for a discharge lamp between the electrode side and the external lead side in the metal foil, or by contracting the side tube portion so that a portion on the electrode side and a portion on the external lead side in the metal foil are brought relatively close to each other.

Hereinafter, the functions of the present invention will be described.

The discharge lamp of the present invention has a twist structure in at least one of a pair of metal foils, and therefore the internal stresses (internal stresses of the metal foils) occurring perpendicularly to the surface of the metal foils in the sealing portions are not directed to one and the same direction. Therefore, the directions of the internal stresses of the metal foils can be dispersed. When the directions of the internal stresses of the metal foils can be dispersed, the synthetic stress that causes the metal foils to split the sealing portions (the synthetic stress destroying the sealing structure) can be reduced. Thus, the sealing structure of the sealing portions can be maintained for a long time, compared with the prior art. As a result, the lifetime of the discharge lamp can be prolonged. When the metal foils are twisted 90°, the synthetic stress that causes the metal foils to split the sealing portions can be minimized.

Also when at least one of the pair of metal foils has a corrugated structure, the internal stresses in the sealing portions can be dispersed. As a result, the lifetime of the discharge lamp can be longer than that of the prior art. When a bend portion for dispersing the directions of the internal stresses of the metal foils in the sealing portions is formed in at least one of the metal foils, the synthetic stress that causes the metal foils to split the sealing portions can be reduced. In the case of this structure, when a wave portion is provided in an area between the edge of the electrode and the edge of the external lead of the metal foil, the internal stresses in the sealing portion can be dispersed without reducing the connection strength between the electrode and the metal foil and the connection strength between the external lead and the metal foil. Furthermore, when a wave crest of the wave portion is provided in an area on the luminous bulb side from the midpoint of the metal foil, the sealing structure in the sealing portion can be maintained for a long time more effectively. In addition, a plurality of wave crests are provided in the wave portion.

When a first direction perpendicular to the thickness direction of one of the pair metal foils is different from a second direction perpendicular to the thickness direction of the other metal foil, the sum of the internal stresses of the first directions and the second directions can be lower than that of the prior art. Therefore, the synthetic stress that causes the metal foils to split the sealing portions can be weakened, so that the lifetime of the discharge lamp can be prolonged. It is preferable that the first direction is dislocated by 1 to 90° from the second direction. When the first direction is dislocated by 90° from the second direction, the sum of the internal stresses in the first direction and the second direction can be minimized. In addition, in order to disperse the internal stresses of the sealing portion, at least one of the pair of metal foils has the twist structure or the corrugated structure.

When the metal foil is formed in such a manner that the area of the metal foil projected from the luminous bulb side to the external lead side is larger than the area of the end face of the metal foil, the surface of the metal foil can receive energy moving from the luminous bulb to the external leads in a manner similar to in an optical fiber. For this reason, the energy by the optical fiber-like effect that reaches the junction portions between the metal foils and the external leads can be reduced. As a result, the temperature increase in the junction portions between the metal foils and the external leads can be reduced.

Each of the pair of metal foils can be designed to be pressed by the glass portions extended from the luminous bulb, and a molybdenum foil can be used as each of the pair of metal foils. In order to make it difficult for the sealing portions to split, a metal foil having a sharp side is used preferably.

When the external leads are formed integrally with the molybdenum foils, heat generation by current generated in the welded portions of the external leads and the molybdenum foils in the prior art can be suppressed. Thus, compared with the prior art, it is possible to suppress the generation of the starting point of cracks in the sealing portions (glass portions) in the periphery of the welded portions by the local temperature increase in the welded portions, so that the lifetime of the discharge lamp can be prolonged.

Furthermore, when the external leads are formed integrally with the molybdenum foils, this structure makes it difficult to form the gap between the junction portions between the molybdenum foils and the external leads and the sealing portions (glass portions). As a result, the strength of the sealing portions can be improved. When the portion of the external lead that is connected to the molybdenum foils is planed, heat generation due to current occurring in the welded portion can be suppressed, and it is difficult to form the gap between the junction portions and the sealing portions (glass portions), compared with the prior art.

Furthermore, when a molybdenum rod extended from the molybdenum foil to the luminous bulb is connected to one of a pair of electrodes by welding, the junction portion between the molybdenum foil and the electrode can have a smooth shape so that cracks are unlikely to remain in the sealing portion (glass portion) in the periphery of the junction portions. As a result, the strength of the discharge lamp can be improved.

It is preferable that each of the pair of sealing portions has a shrink sealing structure to improve the resistance to pressure. Examples of the discharge lamp of the present invention include a mercury lamp comprising at least mercury as a luminous material (including ultra high pressure mercury lamp, high pressure mercury lamp and low pressure mercury lamp). Alternatively, a lamp unit including the discharge lamp of the present invention in combination with a reflecting mirror can be formed. Furthermore, according to the method for producing a discharge lamp of the present invention, a discharge lamp including a metal foil having the twist structure or the corrugated structure can be produced relatively easily.

According to one embodiment of the discharge lamp of the present invention, since at least one of a pair of metal foils has a twist structure, the sealing structure in the sealing portion can be maintained for a long time, so that the lifetime of the discharge lamp can be prolonged.

According to another embodiment of the discharge lamp of the present invention, since at least one of a pair of metal foils has a corrugated structure, the sealing structure in the sealing portion can be maintained for a long time, so that the lifetime of the discharge lamp can be prolonged.

According to still another embodiment of the discharge lamp of the present invention, since a first direction perpendicular to the thickness direction of one metal foil is different from a second direction perpendicular to the thickness direction of the other metal foil, the sealing structure in the sealing portion can be maintained for a long time, so that the lifetime of the discharge lamp can be prolonged.

According to yet another embodiment of the discharge lamp of the present invention, since the area of the metal foil projected from the luminous bulb side to the external lead side is larger than the area of the end face of the metal foil, the temperature increase generated by energy by the optical fiber-like effect can be suppressed, and the reliability of the discharge lamp can be improved.

According to another embodiment of the discharge lamp of the present invention, at least one of a pair of molybdenum foils is formed integrally with the external lead. Therefore, the local temperature increase in the sealing portion can be prevented, and the lifetime of the discharge lamp can be prolonged.

According to still another embodiment of the discharge lamp of the present invention, the portion connected to the molybdenum foil is plane welded with the external leads having a plane shape. Therefore, the local temperature increase in the sealing portion can be prevented, and the lifetime of the discharge lamp can be prolonged.

According to still another embodiment of the discharge lamp of the present invention, since the molybdenum foil has a molybdenum rod extending from the molybdenum foil to the luminous bulb, and the molybdenum rod is welded to either one of the pair of electrodes. Therefore, the strength of the sealing portion can be prevented from deteriorating, so that the lifetime of the discharge lamp can be prolonged.

According to the method for producing a discharge lamp of the present invention, a discharge lamp including a sealing portion having the twist structure or the corrugated structure can be produced relatively easily.

This and other advantages of the present invention will become apparent to those skilled in the art upon reading and understanding the following detailed description with reference to the accompanying figures.

DETAILED DESCRIPTION OF THE INVENTION

Figure 1A:
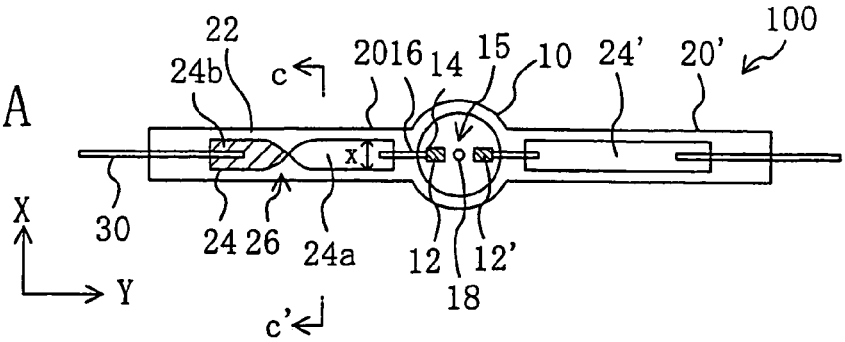
FIG. 1A is a schematic top view showing a structure of a discharge lamp 100 of Embodiment 1.

Hereinafter, embodiment of the present invention will be described with reference to the accompanying drawings. In the following drawings, the elements having substantially the same functions bear the same reference numeral.

EMBODIMENT 1

A discharge lamp 100 of Embodiment 1 of the present invention will be described with reference to FIGS. 1 to 4.

Figure 1B:
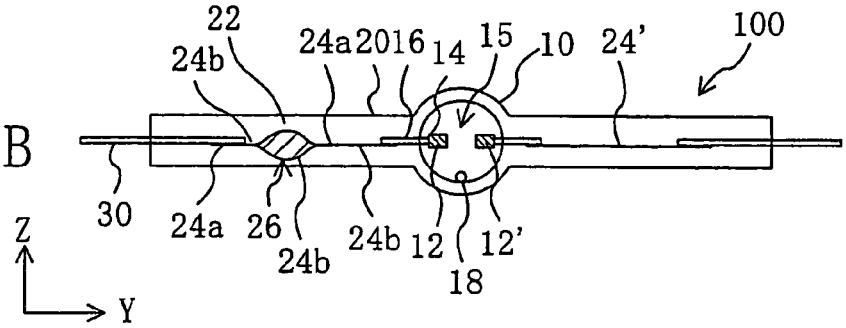
FIG. 1B is a schematic side view showing a structure of a discharge lamp 100 of Embodiment 1.
Figure 1C:
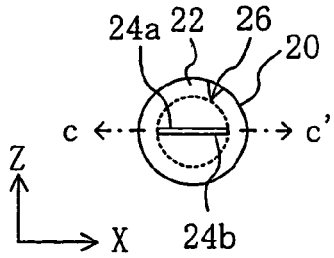
FIG. 1C is a cross-sectional view taken along line c–c' of FIG. 1A.
Figure 1D:
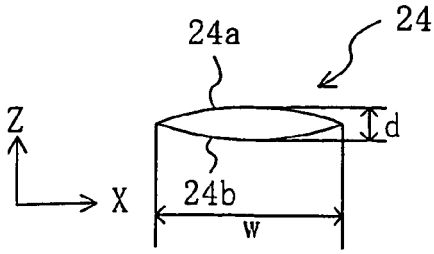
FIG. 1D is a schematic enlarged view showing the shape of an end face of a metal foil 24.

First, FIGS. 1A to 1D are referred to. FIG. 1A is a schematic top view showing a structure of a discharge lamp 100 of Embodiment 1. FIG. 1B is a schematic side view showing a structure of the discharge lamp 100. FIG. 1C is a cross-sectional view taken along line c–c' of FIG. 1A. FIG. 1D is a schematic enlarged view showing the shape of an end face of a metal foil 24. The arrows X, Y and Z in FIGS. 1A to 1D show the coordinate axes.

The discharge lamp 100 of Embodiment 1 includes a luminous bulb (bulb) 10, and a pair of sealing portions 20 and 20' connected to the luminous bulb 10.

A discharge space 15 in which a luminous material 18 is enclosed is provided inside the luminous bulb 10. A pair of electrodes 12 and 12' are opposed to each other in the discharge space 15. The luminous bulb 10 is made of quartz glass and is substantially spherical. The outer diameter of the luminous bulb 10 is, for example, about 5 mm to 20 mm. The glass thickness of the luminous bulb is, for example, about 1 mm to 5 mm. The volume of the discharge space 15 in the luminous bulb 10 is, for example, about 0.01 to 1 cc. In this embodiment, the luminous bulb 10 having an outer diameter of about 13 mm, a glass thickness of about 3 mm, a volume of the discharge space 15 of about 0.3 cc is used. As the luminous material 18, mercury is used. For example, about 150 to 200 mg/cm$^3$ of mercury, a rare gas (e.g., argon) with 5 to 20 kPa, and a small amount of halogen are enclosed in the discharge space 15. In FIGS. 1A and 1B, mercury 18 attached to the inner wall of the luminous bulb 10 is schematically shown.

The pair of electrodes 12 and 12' in the discharge space 15 are arranged with a gap (arc length) of, for example, about 1 to 5 mm. As the electrodes 12 and 12', for example, tungsten electrodes (W electrodes) are used. In this embodiment, the W electrodes 12 and 12' are arranged with a gap of about 1.5 mm. A coil 14 is wounded around the end of each of the electrodes 12 and 12'. The coil 14 has a function to lower the temperature of the electrode end. An electrode axis (W rod) 16 of the electrode 12 is electrically connected to the metal foil 24 in the sealing portion 20. Similarly, an electrode axis 16 of the electrode 12' is electrically connected to the metal foil 24' in the sealing portion 20'.

The sealing portion 20 includes a metal foil 24 electrically connected to the electrode 12 and a glass portion 22 extended from the luminous bulb 10. The airtightness in the discharge space 15 in the luminous bulb 10 is maintained by the foil-sealing between the metal foil 24 and the glass portion 22 In other words, the sealing portion 20 is a portion foil-sealed by the metal foil 24 and the glass portion 22. The metal foil 24 is a molybdenum foil (Mo foil), for example, and has a rectangular shape, for example. The glass portion 22 is made of quartz glass, for example.

As shown in FIG. 1D, the thickness d of the metal foil 24 is about 20 μm to 30 μm. The width w of the metal foil 24 is for example, about 1.5 mm to 2.5 mm. The ratio of the thickness d to the width w is about 1:100. In this embodiment, as shown in FIG. 1D, the side of the metal foil 24 is sharp. This design is adopted to prevent the internal stress occurring perpendicularly to the side of the metal foil 24 from being directed to a direction x perpendicular to the direction Z of the thickness of the foil as much as possible, so that the sealing portion 20 is prevented from splitting as much as possible. This design of the sealing portion 20 applies to the sealing portion 20', so that further description is omitted.

Figure 2:
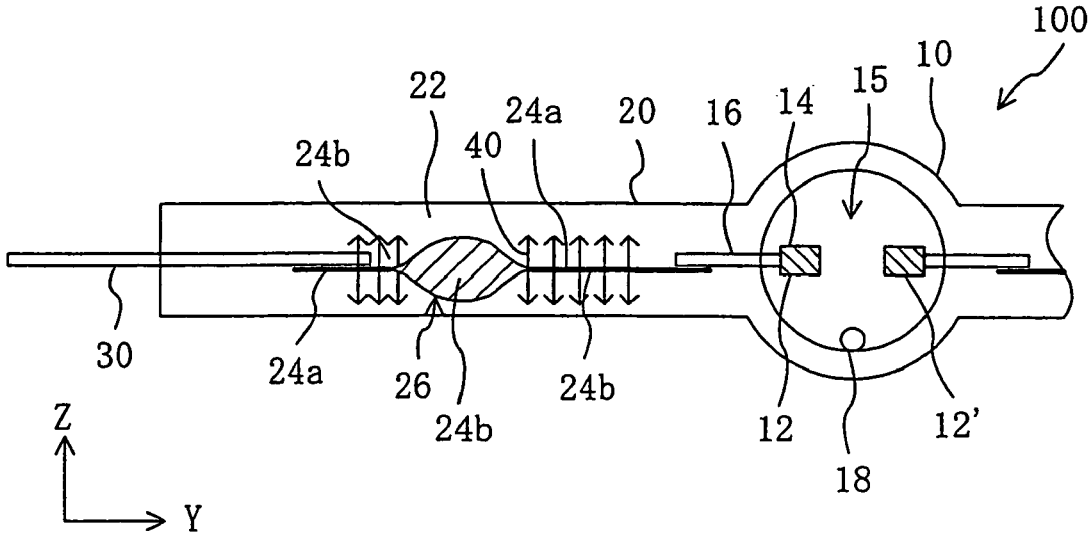
FIG. 2 is a cross-sectional enlarged view showing a twist structure of the metal foil.

The metal foil 24 of at least one of the pair of sealing portions (the sealing portion 20 in the drawings) has a twist structure, and the metal foil 24 has a twisted portion (twist portion) 26 with respect to the other portion (e.g., the portion on the luminous bulb 10 side of the metal foil 24). FIG. 2 is an enlarge view showing the twist structure of the metal foil 24.

As shown in FIG. 2, with the metal foil 24 of the twist structure, the direction of the internal stresses 40 occurring perpendicularly to an upper surface 24*a* and a lower surface 24*b* of the metal foil 24 are not uniform to the thickness direction Z of the foil. Accordingly, the directions of the internal stresses 40 of the metal foil 24 can be dispersed to directions other than the thickness direction Z of the foil, so that the synthetic stress that causes the metal foil 24 to split the sealing portion 20 (glass portion 22), that is, the synthetic stress of the internal stresses 40 in the thickness direction Z of the foil, can be reduced. As a result, the sealing structure of the sealing portion 20 can be maintained for a long time, and the lifetime of the discharge lamp 100 can be prolonged.

In this embodiment, the angle of the twisted portion 26 (twist angle) with respect to the portion on the luminous bulb 10 side of the metal foil 24 is about 180 degrees. However, the twist angle is not limited to about 180 degree. In order to reduce more significantly the synthetic stress that causes the metal foil 24 to split the sealing portion 20 (glass portion 22), that is, the synthetic stress of the internal stresses 40 in the thickness direction of the foil, it is preferable that the twist angle is at least 30 degrees. In order to reduce the synthetic stress splitting the sealing portion 20 by about 15%, it is preferable that the twist angle is, for example, about 45 degrees.

When the twist angle is 90°, the synthetic stress splitting the sealing portion 20 is smallest, so that it is more preferable that the twist angle of at least one twist portion 26 is 90°. The twist angle of the twist portion 26 can be 90 degrees or more, and can be 180 degrees as in this embodiment. When the twist angle is about 180 degrees, each the upper surface 24*a* and the lower surface 24*b* of the metal foil 24 draw a locus of a semicircle, when viewed from the luminous bulb 10 side, as shown by a dotted line in FIG. 1C. The twist portion 26 is formed in at least one portion in the metal foil 24. In order to reduce the synthetic stress splitting the sealing portion 20 to a larger extent, it is preferable to form a plurality of twist portions. Furthermore, it is preferable that the twist angle is not less than 36 degrees and the whole metal foil 24 has a twist structure (spiral structure).

In this embodiment, one of the pair of sealing portions 20 has the twist structure, but the other sealing portion 20' can have the twist structure. It is more preferable that both of the sealing portions have the twist structure, because the sealing structures of both of the sealing portions 20 and 20' can be maintained for a long time.

The outer diameter of each of the sealing portions 20 and 20' is, for example, about 4 mm to 8 mm, and the length in the longitudinal direction (the Y direction in FIGS. 1A) thereof is, for example, about 15 mm to 30 mm. It is preferable that the sealing portions 20 and 20' have shrink sealing structures to increase the resistance to sealing pressure. However, in the case where the resistance to sealing pressure of about 4 to 5 MPa of the internal stress is required, a pinch sealing structure can be used.

The metal foil 24 of the sealing portion 20 (or 20') is joined with the electrode 12 by welding, and the metal foil 24 includes an external lead 30 on the side opposite to the side where the electrode 12 is joined. The external lead 30 is made of, for example, molybdenum.

Figure 3A:
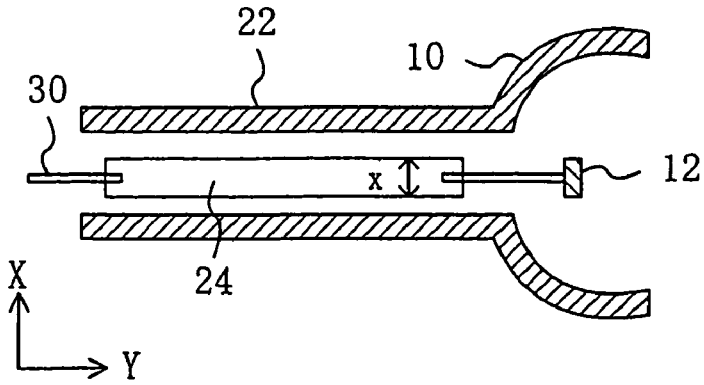
FIGS. 3A to 3C are cross-sectional views of a process sequence for illustrating a method for producing the discharge lamp 100 of Embodiment 1.
Figure 3B:
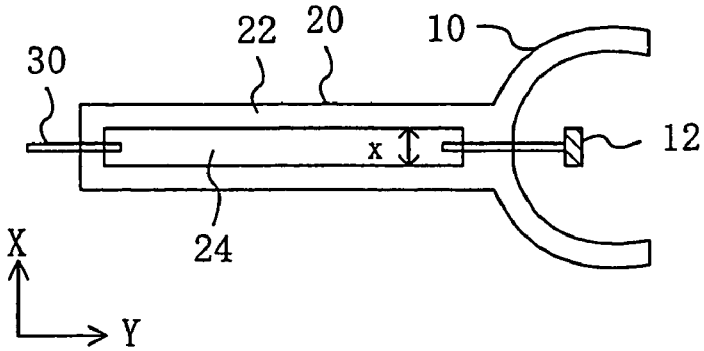
Figure 3C:
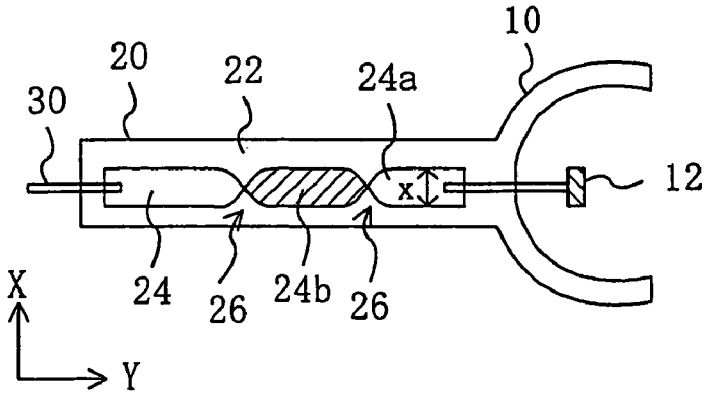

Next, referring to FIGS. 3A to 3C and 4, an illustrative method for producing the discharge lamp 100 will be described. FIGS. 3A to 3C are cross-sectional views showing a process sequence in the method for producing the discharge lamp 100.

As shown in FIG. 3A, the metal foil (Mo foil) 24 having the electrode 12 and the external lead 30 is inserted in a glass pipe for discharge lamps having a portion for the luminous bulb 10 (luminous bulb portion) and a portion for the glass portion 22 (glass tube or side tube portion 22) (electrode insertion process).

Then, as shown in FIG. 3B, the pressure in the glass pipe is reduced (e.g., one atmospheric pressure or less), and the glass tube (side tube portion) 22 is heated and softened, so that the glass tube 22 and the metal foil 24 are attached so that the sealing portion 20 is formed (sealing portion formation process).

Then, as shown in FIG. 3C, while the glass tube (glass portion) 22 is still soft, the sealing portion 20 is twisted, so that the metal foil 24 is also twisted together with the glass tube (glass portion) 22 because the metal foil 24 is soft. Thus, the twist portion 26 can be formed (twist portion formation process). In this manner, the discharge lamp 100 provided with the metal foil 24 having the twist structure can be produced.

Figure 4:
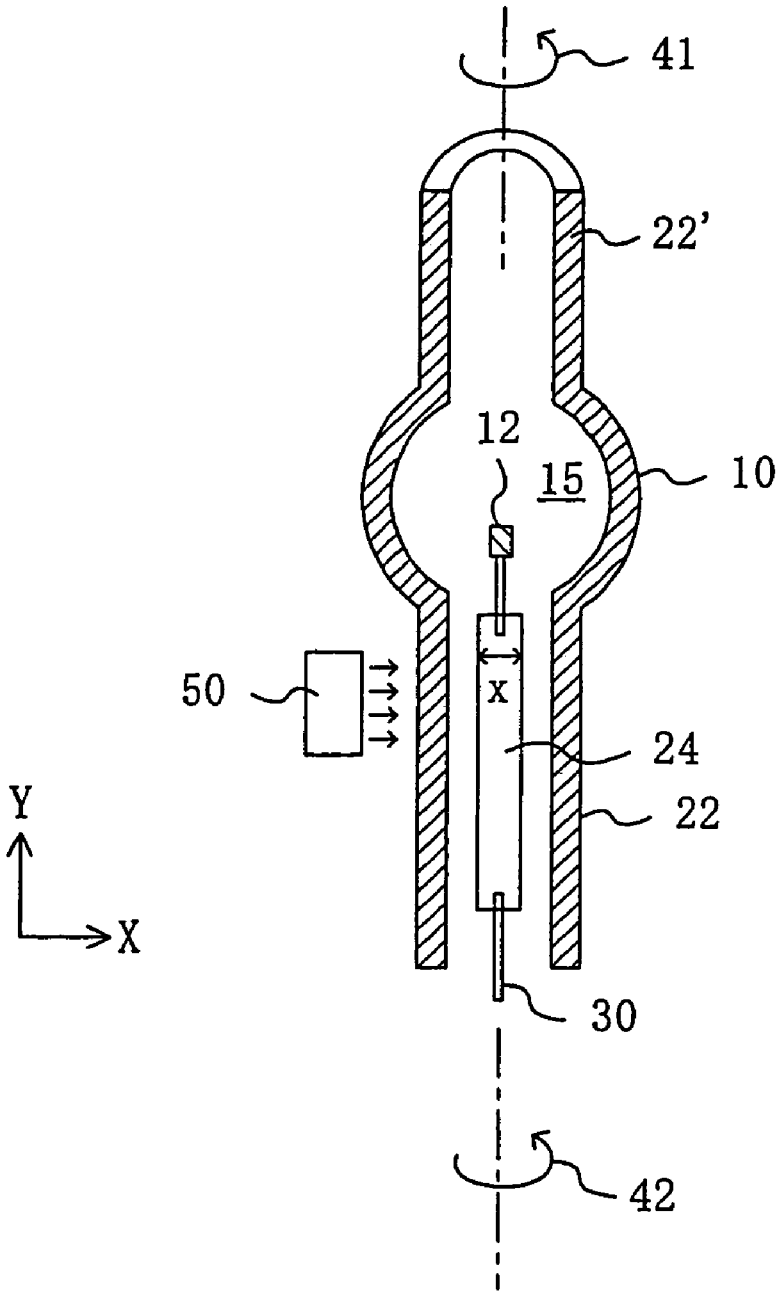
FIG. 4 is a cross-sectional view for illustrating a method for producing the discharge lamp 100 of Embodiment 1.

The electrode insertion process to the twist portion formation process can be performed, for example, in the manner shown in FIG. 4.

First, a glass pipe is disposed in a vertical direction (the Y direction in FIG. 4), and then the upper portion and the lower portion of the glass pipe are supported with a chuck (not shown) so that the glass pipe can be rotated in the direction of the arrows 41 and 42. Next, the metal foil 24 having the electrode 12 and the external lead 30 is inserted in a glass pipe, and then the glass pipe is put to be ready for pressure reduction. Then, the pressure in the glass pipe is reduced (e.g., 20 kPa), and the glass pipe is rotated in the directions shown by the arrows 41 and 42, and then a part of the glass tube 22 is heated and softened by, for example, a burner 50.

The glass tube 22 and the metal foil 24 are attached by the difference in the pressure between the inside and the outside of the glass tube 22. Then, the rotation speed is made different between the upper portion and the lower portion of the glass pipe. Thus, a part of the glass tube 22 heated and softened by the burner 50 is twisted, and thus the twist portion 26 can be formed in this portion. In order to make the rotation speed different between the upper portion and the lower portion of the glass pipe, for example, the rotation of the upper portion of the glass pipe as shown by the arrow 41 is not changed, and the rotation of the lower portion of the glass pipe as shown by the arrow 42 is stopped.

More specifically, the method shown in FIG. 4 can be performed in the manner shown in FIGS. 5A to 5D. FIGS. 5A to 5D are cross-sectional views of a process sequence for illustrating a method for producing the discharge lamp 100 of this embodiment.

Figure 5A:
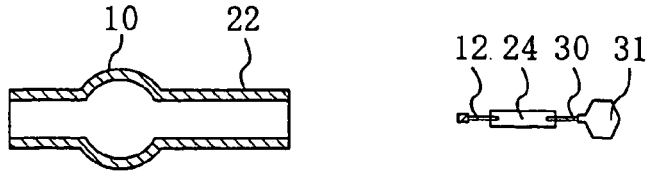
FIGS. 5A to 5D are cross-sectional views of a process sequence for illustrating a method for producing the discharge lamp 100 of Embodiment 1.

First, as shown in FIG. 5A, a pipe for a discharge lamp including a luminous bulb portion 10 and a side tube portion 22 and an electrode assembly including a metal foil (Mo foil) 24, an electrode 12 connected to the metal foil, and an external lead 30 connected to the metal foil. A supporting member 31 for fixing the electrode assembly in the inner surface of the side tube portion 22 is provided in one end of the external lead 30 of the electrode assembly. For example, a molybdenum tape (Mo tape) made of molybdenum can be used as the supporting member 31. As the metal foil 24 of the electrode assembly, a substantially straight foil can be used. In other words, in this embodiment, the metal foil 24 is not twisted at first.

It is preferable that the glass pipe for a discharge lamp prepared in this embodiment is made of quartz comprising a low level of impurities to prevent blackening and devitrification in the luminous bulb effectively. In this embodiment, a high purity quartz glass comprising a very low level, for example, several ppm or less, preferably, 1 ppm or less each of alkali impurities (Na, K, Li). However, the present invention is not limited thereto, and it is possible to prepare and use a glass pipe for a discharge lamp made of quartz glass comprising a not so low level of alkali impurities.

Figure 5B:
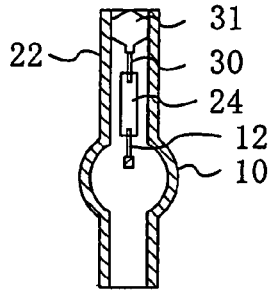

Next, as shown in FIG. 5B, the prepared glass pipe is disposed in a vertical direction with a chuck (not shown), and then the electrode assembly is inserted in the side tube portion 22 so that the end of the electrode 12 is in a predetermined position in the luminous bulb portion 10 with the metal foil 24 in a straight state. When the end of the electrode 12 is positioned in the predetermined position, the electrode assembly is fixed in the side tube portion 22 with the Mo tape 31. Thereafter, the entire glass pipe is purged with an inert gas at one atmospheric pressure or less (e.g., Ar gas at about 50 Torr).

Figure 5C:
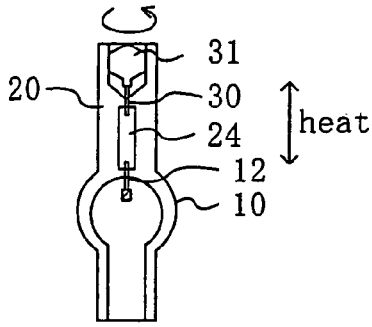
Figure 5D:
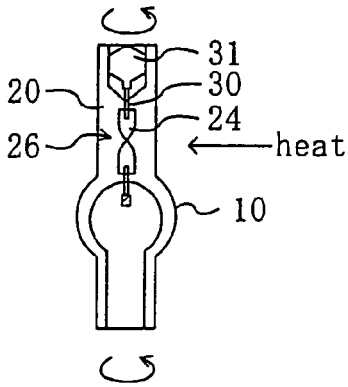

Next, as shown in FIG. 5C, the side tube portion 22 is heated and melted while rotating the glass pipe, so that the entire metal foil 24 of the electrode assembly is attached to the side tube portion 22 for sealing so as to form the sealing portion 20. Thereafter, as shown in FIG. 5D, first, the sealing portion 20 (glass portion 22) corresponding to a site to be twisted of the metal foil 24 is heated and melted. Then, the rotation speed in one end of the glass pipe is made different from that in the other end, so that the twist portion 26 is formed in the metal foil 24. Thus, the metal foil 24 having the twist structure can be produced relatively easily. Therefore, the discharge lamp 100 of this embodiment can be obtained by a known technique.

The metal foil 24 having the twist structure can be produced in the manner shown in FIGS. 6A to 6D.

Figure 6A:
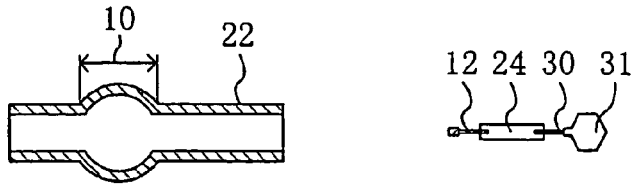
FIGS. 6A to 6D are cross-sectional views of a process sequence for illustrating another method for producing the discharge lamp 100 of Embodiment 1.
Figure 6B:
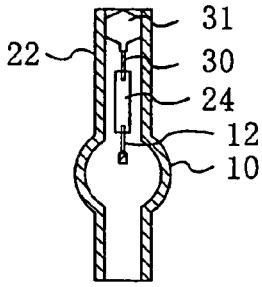

First, in the same manner as shown in FIGS. 5A and 5B, as shown in FIGS. 6A and 6B, the electrode/assembly is inserted in the side tube portion 22 of the prepared glass pipe, and then the glass pipe is purged with an inert gas with one atmospheric pressure or less.

Figure 6C:
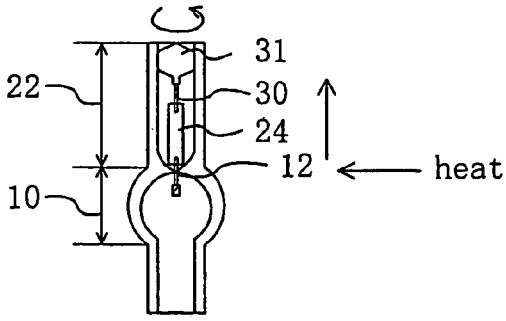
Figure 6D:
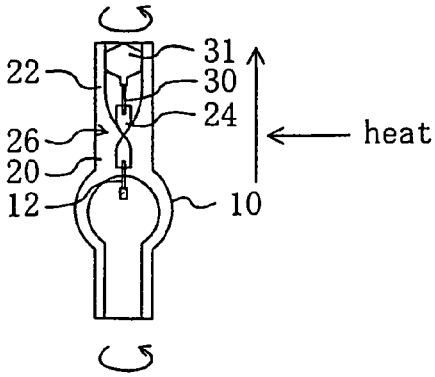

Next, as shown in FIG. 6C, the glass pipe is heated and melted from around a boundary portion between the luminous bulb portion 10 and the side tube portion 22 toward the end of the side tube portion 22 (upper portion) to shrink the side tube portion 22 so that a part of the metal foil 24 of the electrode assembly and a part of the side tube portion (glass portion) 22 are attached for sealing. Then, as shown in FIG. 6D, when heating reaches the site to be twisted of the metal foil 24, the rotation speed in one end of the glass pipe is made different from that in the other end, so that the twist portion 26 can formed in the metal foil 24. Thereafter, the rotation speeds are returned to be the same, so that the metal foil 24 is attached to the side tube portion 22 for sealing in a straight state again. In this manner as well, the metal foil 24 having the twist structure can be produced.

In the example shown in FIGS. 6A to 6D, heating and melting is performed from the boundary portion between the luminous bulb portion 10 and the side tube portion 22 toward the end of the side tube portion 22. However, heating and melting can be performed from the end of the side tube portion 22 toward the boundary portion between the luminous bulb portion 10 and the side tube portion 22. In this case as well, when heating reaches the site to be twisted of the metal foil 24, the twist portion 26 is formed in the metal foil 24 by making the rotation speed in one end of the glass pipe different from that in the other end.

According to the discharge lamp 100 of this embodiment, the metal foil 24 in the sealing portion 20 has the twist structure, so that the internal stresses 40 in the sealing portion 20 can be dispersed. Therefore, compared with the prior art, the sealing structure of the sealing portion 20 can be maintained for a long time and the lifetime of the lamp can be prolonged.

EMBODIMENT 2

A discharge lamp 200 of Embodiment 2 of the present invention will be described with reference to FIGS. 7 to 9. The discharge lamp 200 of this embodiment is different from the discharge lamp 100 of Embodiment 1 provided with the metal foil 24 having the twist structure, in that the metal foil 24 has a corrugated structure in Embodiment 2. For simplification of description of this embodiment and the following embodiments, the points different from Embodiment 1 will be described, and description of the same points are either omitted or simplified.

Figure 7A:
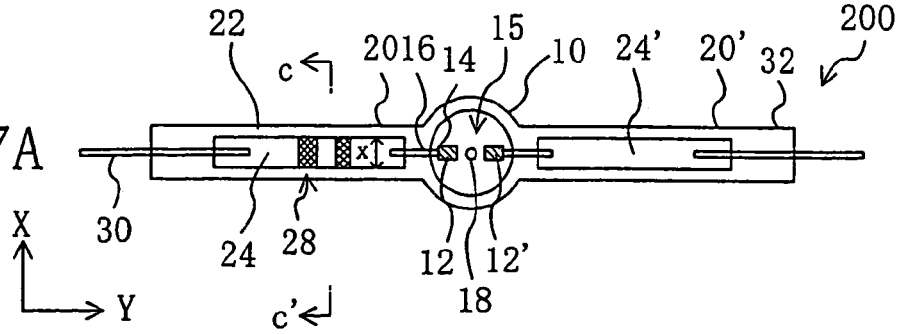
FIG. 7A is a schematic top view showing a structure of a discharge lamp 200 of Embodiment 2.
Figure 7B:
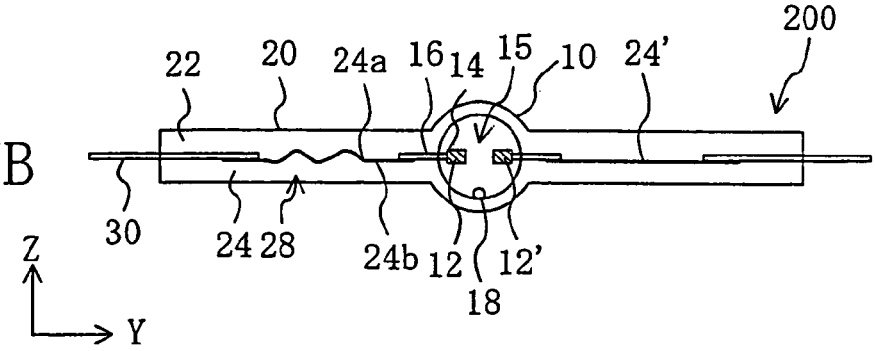
FIG. 7B is a schematic side view showing a structure of a discharge lamp 200 of Embodiment 2.
Figure 7C:
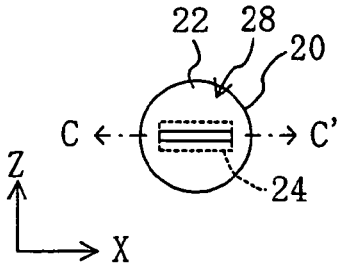
FIG. 7C is a cross-sectional view taken along line c–c' of FIG. 7A.

FIG. 7A is a schematic top view of the discharge lamp 200 of this embodiment. FIG. 7B is a schematic side view of the discharge lamp 200. FIG. 7C is a cross-sectional view taken along line c–c' of FIG. 7A.

The discharge lamp 200 of Embodiment 2 includes a luminous bulb 10, and a pair of sealing portions 20 and 20' connected to the luminous bulb 10. The metal foil 24 of at least one of the pair of sealing portions 20 and 20' (the sealing portion 20 in FIGS. 7A to 7C) has a corrugated structure. The metal foil 24 having a corrugated structure has at least one wave portion (bend portion) 28 for dispersing the internal stresses 40 in the metal foil 24. When the wave portion (bend portion) 28 is formed in the metal foil 24, as shown by a dotted line in FIG. 7C, the upper surface 24*a* and the lower surface 24*b* of the metal foil 24 in the portion in which the wave portion 28 is formed appear beyond the upper and the lower edges of the end face of the metal foil 24, when viewed from the luminous bulb 10 side. FIG. 8 is an enlarged view of the corrugated structure of the metal foil 24.

Figure 8:
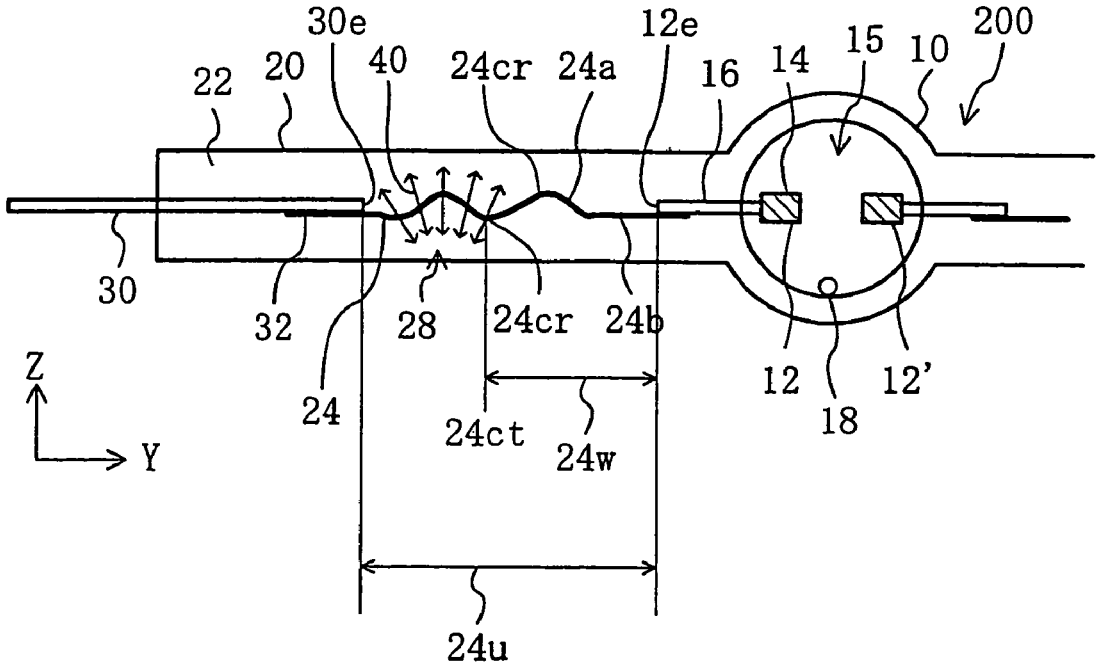
FIG. 8 is a cross-sectional enlarged view showing a corrugated structure of the metal foil.

As shown in FIG. 8, when the metal foil 24 has the corrugated structure in which the metal foil 24 is corrugated in the longitudinal direction (Y direction), the internal stresses 40 occurring perpendicularly to the upper surface 24*a* and the lower surface 24*b* of the metal foil 24 are not directed uniformly to the thickness direction Z of the foil. Thus, the internal stresses 40 of the metal foil 24 can be dispersed, so that the synthetic stress that causes the metal foil 24 to split the sealing portion 20 (glass portion 22), that is, the synthetic stress of the internal stress 40 in the thickness direction Z of the foil, can be reduced. As a result, the sealing structure of the sealing portion 20 can be maintained, so that the lifetime of the discharge lamp 100 can be prolonged.

It is preferable that the wave portion 28 is formed in an area 24*u* that is from the end 12*e* of the electrode 12 to the end 30*e* of the external lead 30 of the metal foil 24. The reason is as follows. Since the electrode 12 and the external lead 30 are connected to the metal foil 24 by welding, the connection strength between the electrode 12 and the metal foil 24 and the connection strength between the external lead 30 and the metal foil 24 can be prevented from being reduced by forming the wave portion 28 in the area 24*u* that is not in the welded portion.

Furthermore, since the split between the metal foil 24 and the glass portion 22 of the sealing portion 20 in use of the lamp occurs from the luminous bulb 10 side of the sealing portion 20, it is preferable to provide the wave portion 28 on the luminous bulb 10 side rather than on the external lead 30. For example, based on the longitudinal direction (Y direction), a wave crest 24*cr* of the wave portion 28 is provided in an area 24*w* that is from the midpoint (24*ct*) of the metal foil 24 to the end 12*e* of the electrode 12. The area 24*w* includes the midpoint 24*ct*. In this embodiment, the wave crest 24*cr* extends in the direction of the shorter side of the metal foil 24 (X direction), and is formed across the metal foil 24. It is preferable to form a plurality of wave crests 24*cr* in the area 24*u* to disperse the internal stresses 40 effectively.

In this embodiment, two wave portions 28 are formed in the metal foil 24 having the corrugated structure. However, forming at least one wave portion 28 can reduce the synthetic stress that causes the metal foil 24 to split the sealing portion 20 over the prior art. Therefore, it is not necessary for the metal foil 24 having the corrugated structure to have a cyclic corrugated structure. However, the entire metal foil 24 can have a cyclic corrugated structure so that the synthetic stress splitting the sealing portion 20 can be reduced uniformly in the entire portion.

The wave portion 28 has a height (or amplitude) and a radius of curvature that allow the internal stress 40 in the metal foil 24 to be dispersed, and the height (or amplitude) and the radius of curvature of the wave portion 28 can be determined suitably depending on the required conditions. From the constraints of the production process, the maximum height (or amplitude) of the wave portion 28 is defined by the inner diameter of the glass tube 22 portion that becomes the sealing portion of the glass pipe for discharge lamps used in the production process. When the radius of curvature of the wave portion, 28 is small rather than large, the internal stresses 40 in the metal foil 24 can be dispersed more satisfactorily. Therefore, it is preferable to form a plurality of wave portions 28 having a relatively small radius of curvature. In this embodiment, the metal foil 24 has a wave portion 28 with a height of about 1 to 2 mm and a radius of curvature of about 1 to 4 mm. It is preferable to form a wave portion 28 in a smooth shape rather than a sharp shape to disperse the internal stresses 40 in the metal foil 24 satisfactorily. Even the wave portion (bend portion) 28 is sharp, the internal stresses 40 in the metal foil 24 can be dispersed, compared with the prior art.

Whether or not the wave portion 28 is formed in the metal foil 24 can be determined by comparing the length in the longitudinal direction (the Y direction in the drawings) of the metal foil 24 before sealed by the glass portion 22 with the length in the longitudinal direction of the metal foil 24 after the sealing in view of the thermal expansion coefficient. When the wave portion 28 having a predetermined height (or amplitude) and a predetermined radius of curvature is formed, the length in the longitudinal direction of the metal foil 24 after sealing becomes shorter than that before sealing because of the formation of the wave portion 28. In the case where measuring and evaluating the height or the radius of curvature of the wave portion 28 are complicated, a change in the length of the metal foil 24 in the longitudinal direction before and after sealing is measured so that the wave portion 28 can be evaluated.

In this embodiment, one sealing portion 20 of the pair sealing portions has the corrugated structure. However, the other sealing portion 20' can have the corrugated structure as well. It is preferable to provide both of the pair sealing portions with the corrugated structure, because the sealing structure of both of the sealing portions 20 and 20' can be maintained for a long time. Furthermore, one sealing portion 20 can have the corrugated structure and the other sealing 20' can have the twist structure of Embodiment 1. With this design, the sealing structure of both of the sealing portions 20 and 20' can be maintained for a long time. Furthermore, either the sealing portion 20 or 20' can have both the corrugated structure and the twist structure.

Figure 9A:
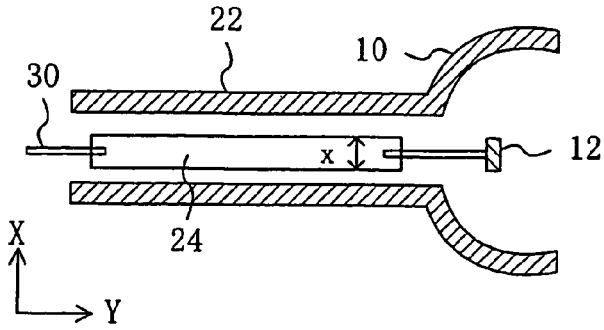
FIGS. 9A to 9C are cross-sectional views of a process sequence for illustrating a method for producing the discharge lamp 200 of Embodiment 2.
Figure 9B:
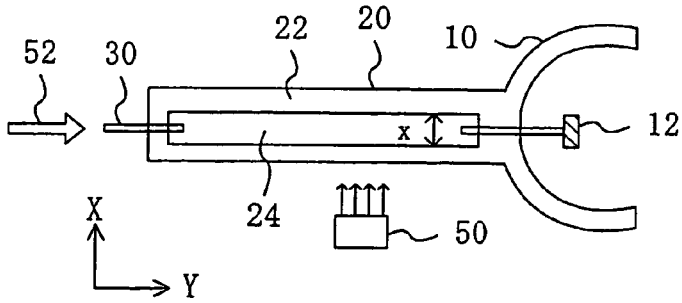
Figure 9C:
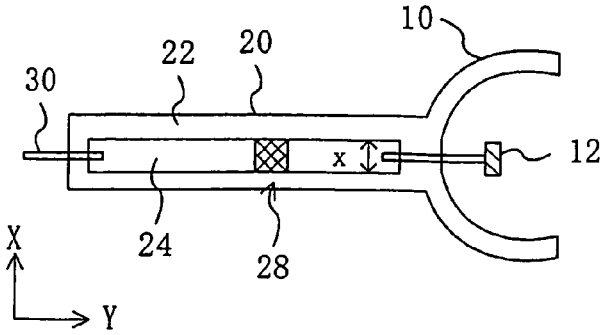

Next, a method for producing the discharge lamp 200 will be described with reference to FIGS. 9A to 9C. FIGS. 9A to 9C are cross-sectional views showing each process in a method for producing the discharge lamp 200.

First, as shown in FIG. 9A, the metal foil (Mo foil) 24 having the electrode 12 and the external lead 30 is inserted in a glass pipe for discharge lamps having a portion for the luminous bulb 10 (luminous bulb portion) and a portion for the glass portion 22 (side tube portion) of the sealing portion (electrode insertion process).

Next, as shown in FIG. 9B, the pressure in the glass pipe is reduced (e.g., one atmospheric pressure or less), and the glass tube 22 is heated and softened by a burner 50, so that the glass tube 22 and the metal foil 24 are attached. Thus, the sealing portion 20 is formed (sealing portion formation process).

In the sealing portion formation process, when a force is applied to the direction of arrow 52, a part of the glass tube (glass portion) 22 that has been heated and softened by the burner 50 is deformed. Since the metal foil 24 is softened, this deformation forms the wave portion 28 in the metal foil 24, as shown in FIG. 9C (wave portion formation process). The force to the direction of the arrow 52 can be applied directly with an instrument or the like, or by utilizing the difference in the pressure between the inside and the outside of the glass pipe. When the wave portion formation process is repeated a plurality of times, a plurality of wave portions 28 can be formed in the metal foil 24.

Furthermore, if the sealing portion formation process can be performed satisfactorily, the discharge lamp 200 provided with the metal foil 24 having the corrugated structure can be produced by the following manner. In the electrode insertion process, the metal foil 24 previously provided with the wave portions 28 is inserted in the glass pipe for discharge lamps, and then the sealing portion forming process is performed. Such a production method is advantageous when a large number of wave portions 28 having a relatively small radius of curvature are formed.

More specifically, the method shown in FIG. 9 can be performed in the manner shown in FIGS. 10A to 10D. FIGS. 10A to 10D are cross-sectional views of a process sequence for illustrating a method for producing the discharge lamp 100 of this embodiment.

Figure 10A:
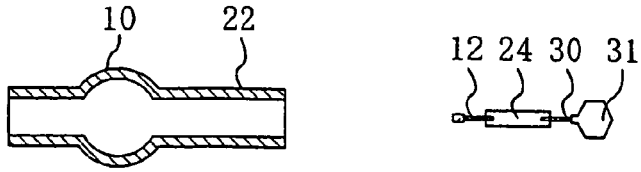
FIGS. 10A to 10D are cross-sectional views of a process sequence for illustrating a method for producing the discharge lamp 200 of Embodiment 2.
Figure 10B:
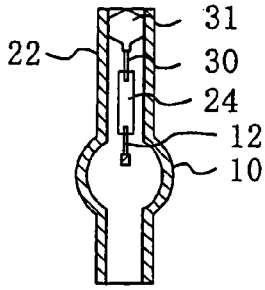

First, as in the same manner shown in FIGS. 5A and 5B, as shown in FIGS. 10A and 10B, the electrode assembly is inserted in the side tube portion 22 of the prepared glass pipe, and then the glass pipe is purged with an inert gas with one atmospheric pressure or less. As the metal foil 24 of the electrode assembly, a substantially straight foil is used.

Figure 10C:
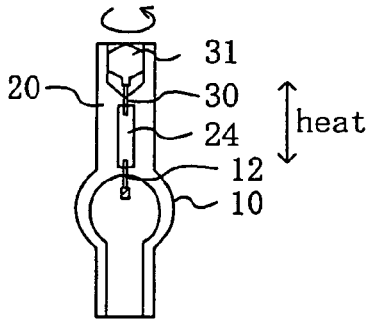

Next, as shown in FIG. 10C, the side tube portion 22 is heated and melted while rotating the glass pipe, so that the entire metal foil 24 of the electrode assembly is attached to the side tube portion 22 for sealing so as to form the sealing portion 20.

Figure 10D:
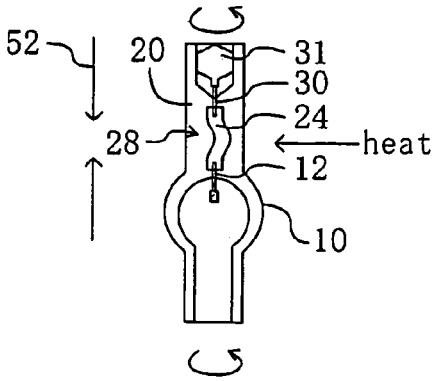

Thereafter, as shown in FIG. 10D, first, the sealing portion 20 (glass portion 22) corresponding to a site to be corrugated of the metal foil 24 is heated and melted. Then, an external force 52 is applied to shrink the glass pipe in the longitudinal direction, so that the wave portion 28 is formed in the metal foil 24. In other words, the side tube portion 22 is contracted so that the electrode 12 side portion is brought relatively close to the external lead 30 side portion, and thus the wave portion 28 can be formed. The wave portion 28 can be formed by moving the glass pipe in such a direction that the glass pipe is contracted in both sides, or by moving only one end with the other end being fixed. Furthermore, as the external force 52, gravity can be utilized.

Thus, the metal foil 24 having the corrugated structure can be produced relatively easily. Therefore, the discharge lamp 200 of this embodiment can be obtained by a known technique. The metal foil 24 having the corrugated structure can be produced in the manner shown in FIGS. 11A to 11D.

Figure 11A:
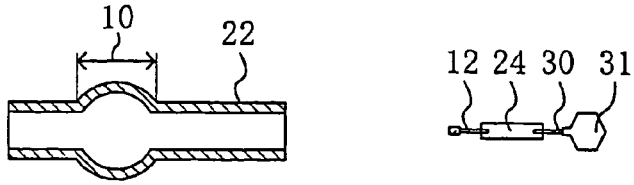
FIGS. 11A to 11D are cross-sectional views of a process sequence for illustrating another method for producing the discharge lamp 200 of Embodiment 2.
Figure 11B:
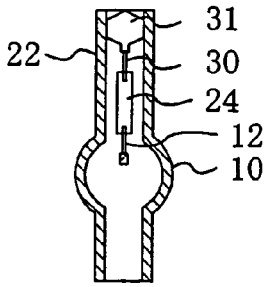

First, in the same manner as shown in FIGS. 10A and 10B, as shown in FIGS. 11A and 11B, the electrode assembly is inserted in the side tube portion 22 of the prepared glass pipe, and then the glass pipe is purged with an inert gas with one atmospheric pressure or less.

Figure 11C:
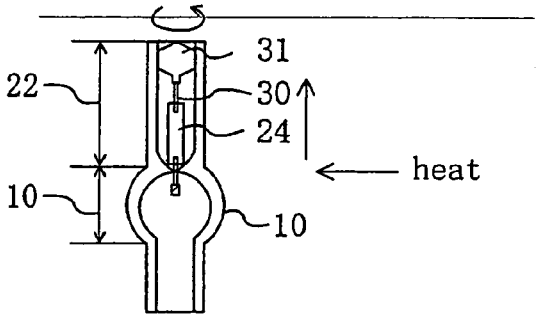

Next, as shown in FIG. 11C, the glass pipe is heated and melted from around a boundary portion between the luminous bulb portion 10 and the side tube portion 22 toward the end (upper portion) of the side tube portion 22 to shrink the side tube portion 22 so that a part of the metal foil 24 of the electrode assembly and a part of the side tube portion (glass portion) 22 are attached for sealing.

Figure 11D:
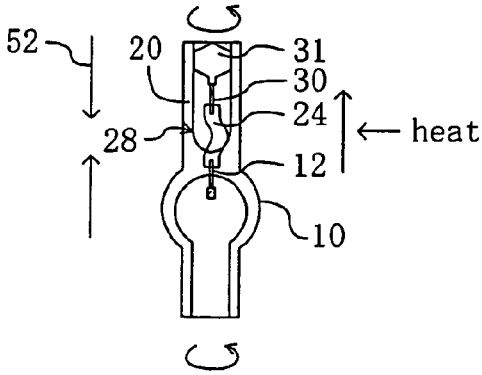

Then, as shown in FIG. 11D, when heating reaches the site to be corrugated of the metal foil 24, both the ends of the glass pipe is contracted in the longitudinal direction, so that the wave portion 28 can be formed in the metal foil 24. The direction of the heating and melting is not limited to from the boundary portion between the luminous bulb portion 10 and the side tube portion 22 toward the end of the side tube portion 22, and heating and melting can be performed from the end of the side tube portion 22 toward the boundary portion between the luminous bulb portion 10 and the side tube portion 22.

Next, a variation of the metal foil 24 having the corrugated structure will be described with reference to FIGS. 12A and 12B.

Figure 12A:
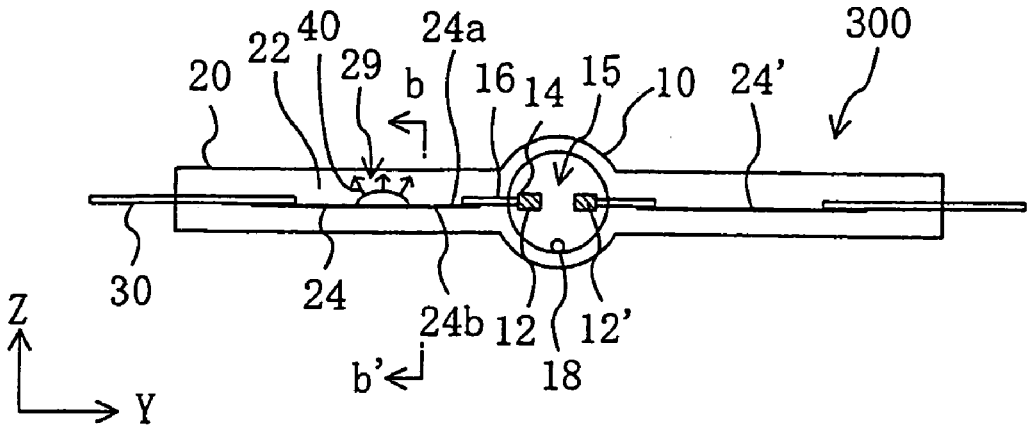
FIG. 12A is a schematic top view showing a structure of a discharge lamp 300 of Embodiment 2.
Figure 12B:
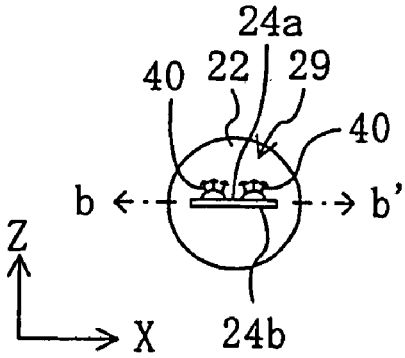
FIG. 12B is a cross-sectional view taken along line b–b' of FIG. 12 A.

As shown in FIG. 12A, instead of the wave portion (bend portion) 28 of the metal foil 24 of the discharge lamp 200, at least one bend portion 29 can be formed on the upper surface 24*a* of the metal foil 24. Also in this discharge lamp 300 provided with the metal foil 24 of the corrugated structure having such a bend portion 29, the internal stresses 40 in the metal foil 24 can be dispersed. Furthermore, as shown in FIG. 12B, a plurality of bend portions 29 can be formed in the direction (the x direction in FIG. 12B)

perpendicular to the thickness direction of the foil. The discharge lamp 300 can be produced by inserting the metal foil 24 previously provided with the bend portion 29 in the glass pipe for a discharge lamp, and then performing the sealing portion formation process.

Figure 13:
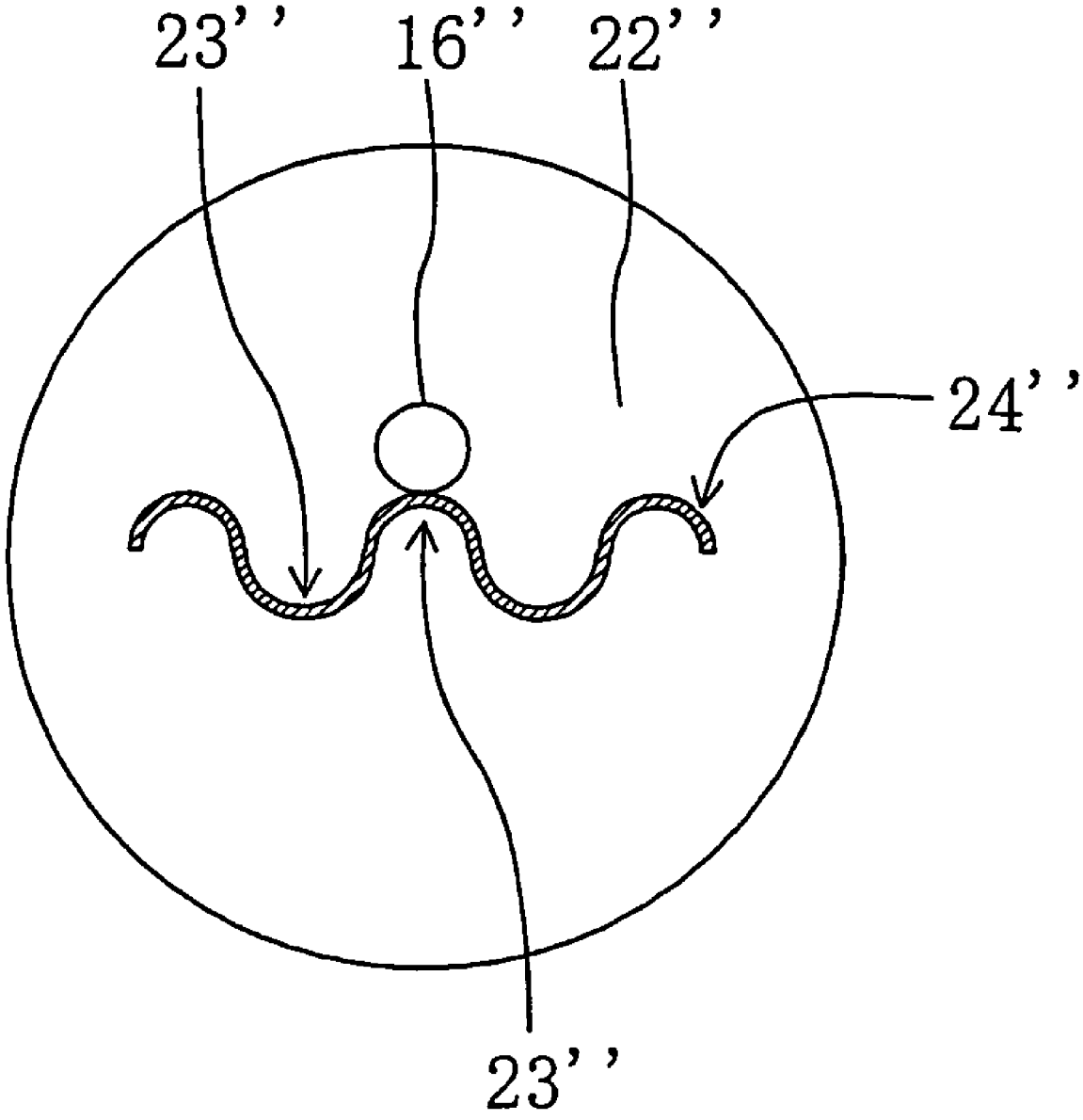
FIG. 13 is a cross-sectional view of a comparative example of the discharge lamp 200 of Embodiment 2.

As shown in FIG. 13, the structure in which the cross section of the metal foil 24" on the shorter side is corrugated is not preferable for the following reason. When the wave crest of the corrugated structure extends along the longitudinal direction (Y direction) of the metal foil 24", the sealing portion forming process (see FIG. 9B) cannot virtually be performed. In other words, in the sealing portion formation process, even if the glass portion 22" is contracted, the recessed area 23" of the metal foil 24" cannot be attached to the glass portion 22", and gaps between the metal foil 24" and the glass portion 22" are generated. Thus, foil-sealing cannot be achieved. Furthermore, it is virtually impossible from a technical point of view to corrugate the metal foil as shown in FIG. 13 after the sealing portion including the metal foil that is not corrugated but straight is formed earlier. In addition, in the structure shown in FIG. 13, the portion of the metal foil 24" that is welded with the electrode rod 16" of the electrode is corrugated, so that the connection strength between the electrode rod 16" and the-metal foil 24" can be reduced.

In the discharge lamp of this embodiment, the metal foil 24 has the corrugated structure, so that the directions of the internal stresses 40 of the metal foil 24 in the sealing portion 20 can be dispersed. Therefore, compared with the prior art, the sealing structure of the sealing portion 20 can be maintained for a long time and the lifetime of the lamp can be prolonged.

EMBODIMENT 3

A discharge lamp 400 of Embodiment 3 of the present invention will be described with reference to FIGS. 14A to 14D and 15A to 15C. The discharge lamp 400 of this embodiment is different from the discharge lamp 100 of Embodiment 1 in that the upper surfaces of a pair of metal foils are nonparallel to each other.

Figure 14A:
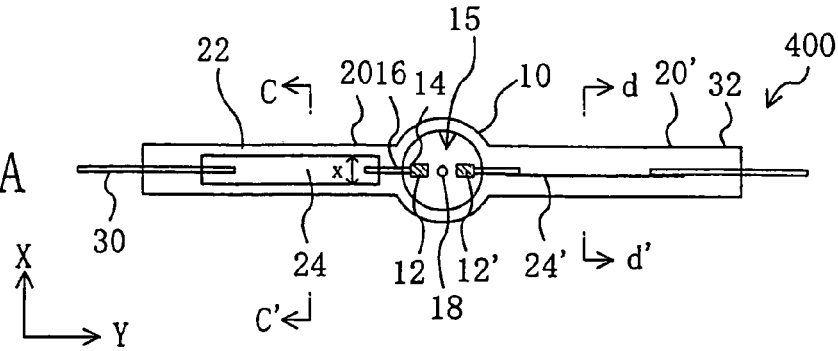
FIG. 14A is a schematic top view showing a structure of a discharge lamp 400 of Embodiment 3.
Figure 14B:
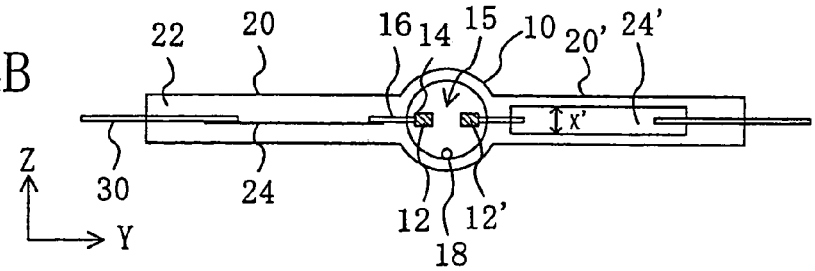
FIG. 14B is a schematic side view showing a structure of the discharge lamp 400.
Figure 14C:
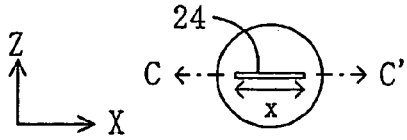
FIG. 14C is a cross-sectional view taken along line c–c' of FIG. 14A.
Figure 14D:
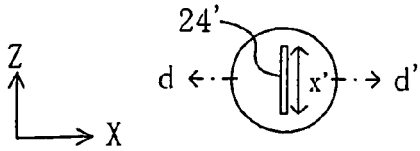
FIG. 14D is a cross-sectional view taken along line d–d' of FIG. 14A.

FIG. 14A is a schematic top view of the discharge lamp 400 of this embodiment. FIG. 14B is a schematic side view of the discharge lamp 400. FIG. 14C is a cross-sectional view of the sealing portion 20 taken along line c–c' of FIG. 14A. FIG. 14D is a cross-sectional view of the sealing portion 20' taken along line d–d' of FIG. 14A.

The discharge lamp 400 of this embodiment includes a luminous bulb 10, and a pair of sealing portions 20 and 20' connected to the luminous bulb 10. The surfaces of a pair of metal foils 24 and 24' of a pair of sealing portions 20 and 20' are nonparallel to each other. More specifically, as shown in FIGS. 14C and 14D, a first direction x perpendicular to the thickness direction of the metal foil 24 in one of the sealing portions 20 is different from a second direction x' perpendicular to the thickness direction of the metal foil 24' in the other sealing portion 20'. In this embodiment, the first direction x of the metal foil 24 and the second direction x' of the metal foil 24' are dislocated by 90°.

Figure 15A:
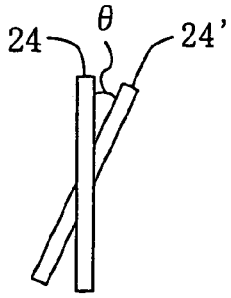
FIGS. 15A to 15C are views for illustrating Embodiment 3.
Figure 15B:
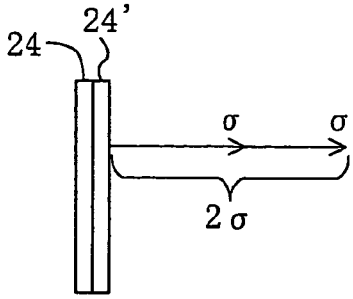
Figure 15C:
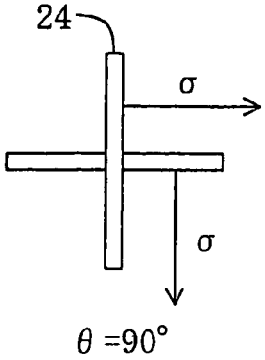

In the discharge lamp 400, the first direction x of the metal foil 24 and the second direction x' of the metal foil 24' are different from each other, so that as shown in FIG. 15A, a dislocation of an angle θ occurs between the metal foils 24 and 24', based on the end faces of the metal foils. As shown in FIG. 15B, when the surfaces of the metal foils 24 and 24' are parallel to each other (angle θ=0°), the synthetic stress of the internal stress σ of the metal foil 24 and the internal stress σ of the metal foil 24' is 2σ. On the other hand, when the angle θ is 90°, for example, as shown in FIG. 15C, the synthetic stress of the internal stresses σ of the metal foil 24 and the metal foil 24' is σ, which is a half of that when the angle θ is 0°.

Thus, when the first direction x of the metal foil 24 and the second direction x' of the metal foil 24' are dislocated, the synthetic stress that causes the pair of the metal foils 24 and 24' to split the pair of the sealing portions 20 and 20' can be reduced, compared with when the first direction x and the second direction x' are the same. As a result, the sealing structure of the sealing portions 20 and 20' can be maintained for a long time and the lifetime of the lamp can be prolonged over the prior art.

In order to reduce the synthetic stress (2σ in FIG. 15B) of the metal foils 24 and 24' when the first direction x of the metal foil 24 agrees with the second direction x' of the metal foil 24' by about 10%, it is preferable that the angle θ is at least 25°. In order to reduce more significantly the synthetic stress of the metal foils 24 and 24', it is preferable that the angle θ is at least 30°. In order to reduce the synthetic stress of the metal foils 24 and 24' by about 15%, it is preferable that the angle θ is at least 45°. As shown in FIG. 15C, when the angle θ is at least 90°, this is most preferable because the synthetic stress of the metal foils 24 and 24' can be the smallest (i.e., 50% reduction from 2σ).

The discharge lamp 400 can be produced by, for example, inserting a pair of metal foils 24 and 24' having electrodes and external leads in a glass pipe for discharge lamps in such a manner that a predetermined angle θ is formed in the electrode insertion process, and then performing the sealing portion formation process.

In this embodiment, the metal foils 24 and 24' having a rectangular and parallel shape. However, it is possible to form the twist portion 26 or the wave portions (bend portions) 28 and 29 of Embodiments 1 and 2 in at least one of the metal foils 24 and 24'. In addition to the effect of this embodiment, the effects of Embodiments 1 and 2 can be obtained by forming the twist portion 26 or the/wave portion 28 or the like in one or both of the metal foils 24 and 24' in this embodiment. When the twist portion or the wave portion is formed, for example, the angle θ can be set based on the portions on the luminous bulb 10 side of the metal foil 24.

In the discharge lamp of this embodiment, the first direction x of the metal foil 24 and the second direction x' of the metal foil 24' are dislocated by the angle θ, so that the synthetic stress that causes the pair of metal foils to split the pair of sealing portions can be reduced. Therefore, the sealing structure of the pair of sealing portions can be maintained for a long time and the lifetime of the lamp can be prolonged.

EMBODIMENT 4

Figure 16A:
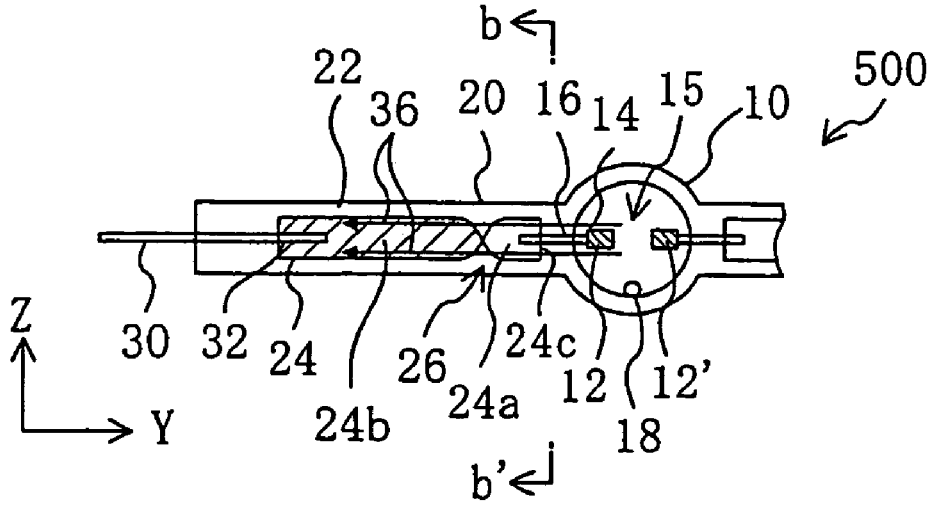
FIG. 16A is a schematic top view showing a structure of a discharge lamp 500 of Embodiment 4.
Figure 16B:
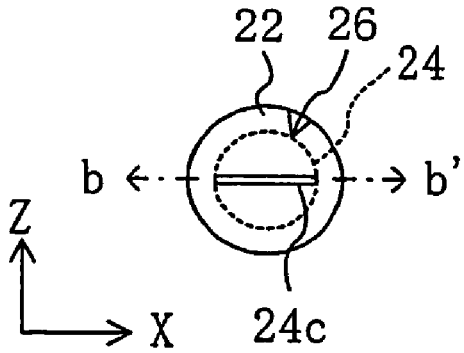
FIG. 16B is a cross-sectional view taken along line b–b' of FIG. 16A.

A discharge lamp 500 of Embodiment 4 of the present invention will be described with reference to FIGS. 16A and 16B. FIG. 16A is a schematic top view of a part of the discharge lamp 500 of this embodiment. FIG. 16B is a cross-sectional view of the sealing portion 20 taken along line b–b' of FIG. 16A.

In the discharge lamp 500 of this embodiment, at least one of a pair of metal foils is as follows. The area of the metal foil (Mo foil) 24 projected from the luminous bulb 10 side to the external lead 30 side is larger than the area of the end face 24*c* of the metal foil 24. In the discharge lamp 500, the twist portion 26 of Embodiment 1 is formed in the metal foil 24 to make the projected area of the metal foil 24 larger than that of the end face 24*c*. More specifically, as shown by a dotted line in FIG. 16B, each of the upper surface and the lower surface of the metal foil 24 forms a semicircle locus when viewed from the luminous bulb 10 side. Thus, the projected area of the metal foil 24 when the metal foil 24 is projected from the luminous bulb 10 side to the external lead 30 side is larger than the area of the end face 24*c* of the metal foil 24. In this embodiment, the metal foil 24 is twisted by 180°, but can be twisted by, for example, 90°. When the metal foil 24 is twisted by 90°, the projected shape of each of the upper surface and the lower surface of the metal foil 24 is a quarter of a circle. Furthermore, the projected area of the metal foil 24 can be larger than the area of the end face 24*c* by forming the wave portion of Embodiment 2.

When the discharge lamp is operated, a large amount of energy (e.g., about 150 W) is introduced in a small space of the luminous bulb 10, and therefore the energy in the luminous bulb 10 moves in the glass portion 22 of the sealing portion 20 in the direction of arrow 36 in a manner similar to in a optical fiber (optical fiber-like effect). The energy moving in the glass portion 22 by the optical fiber-like effect heats a welded portion 32 joining the metal foil 24 and the external lead 30.

In the discharge lamp 500, the projected area of the metal foil 24 is larger than the area of the end face 24*c* of the metal foil 24, and therefore the upper surface or the lower surface of the metal foil 24 can receive the energy moving from the luminous bulb 10 to the external lead 30 by the optical fiber-like effect. Therefore, the energy by the optical fiber-like effect that reaches the welded portion 32 joining the metal foil 24 and the external lead 30 can be reduced from the prior art, so that the temperature increase in the welded portion 32 can be reduced. Molybdenum constituting the metal foil 24 and the external lead 30 is oxidized at 350° C. or more, even if sealing is ensured with the glass portion 22. However, the oxidation of the molybdenum can be prevented by suppressing the temperature increase of the welded portion 32, and thus the reliability of the discharge lamp can be improved. In order to suppress the temperature increase in the welded portion 32, it is preferable to form the twist portion 26 (or the bend portion) on the luminous bulb 10 side rather than in the center of the metal foil 24.

EMBODIMENT 5

Figure 17:
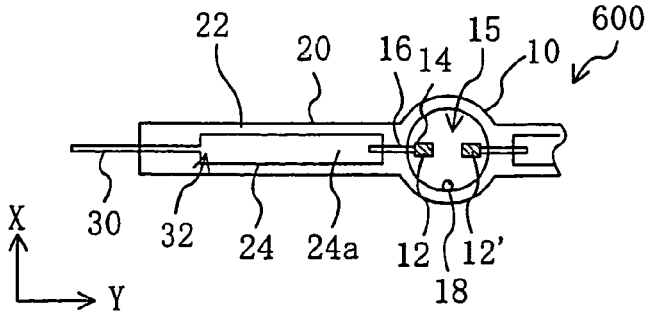
FIG. 17 is a schematic top view showing a structure of a discharge lamp 600 of Embodiment 5.

A discharge lamp 600 of Embodiment 5 of the present invention will be described with reference to FIG. 17. FIG. 17 is a schematic top view of a part of the discharge lamp 600 of this embodiment.

In at least one of a pair of sealing portions 20 of the discharge lamp 600 of this embodiment, the external lead 30 and the metal foil (Mo foil) 24 constituting molybdenum are integrally formed. In the discharge lamp 600, the external lead 30 and the Mo foil 24 are integrally formed in the sealing portion 20, so that the welded portion that might be present in the prior art is not present in the junction 32 between the Mo foil 24 and the external lead 30. For this reason, the contact resistance between the external lead 30 and the Mo foil 24 can be reduced significantly, and a local temperature increase in the junction 32 can be suppressed. Therefore, a larger amount of current can flow than in the prior part while preventing oxidization of the Mo foil 24, and thus higher intensity can be achieved. Furthermore, by suppressing the local temperature increase in the junction 32, the starting point of cracks can be prevented from occurring in the glass portion 22 in the periphery in the junction 32, so that the strength of the sealing portion 20 can be maintained. Furthermore, the junction 32 can have a smooth shape, so that this structure hardly allow a gap to be formed between the junction 32 and the glass portion 22. As a result, the strength of the sealing portion 20, can be improved.

The Mo foil 24 integrally formed with the external lead 30 can be produced by a known technique. For example, a round rod or a square rod (Mo rod) made of molybdenum having a predetermined length is prepared, and then a predetermined portion of the Mo rod is passed through a pair of rollers to be extended to form the Mo foil 24. The unextended portion can be used as the external lead 30. Instead of rollers, dies can be used. The Mo foil 24 integrally formed with the external lead 30 can be produced by embossing.

Figure 18:
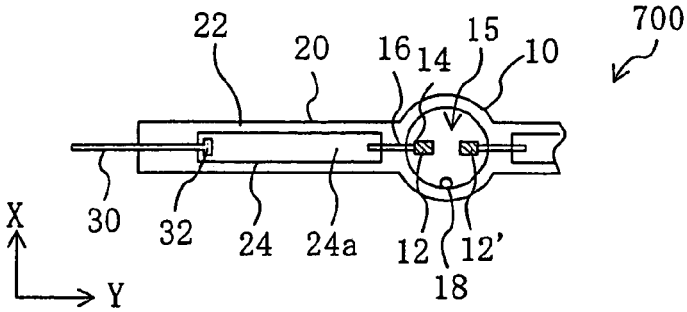
FIG. 18 is a schematic top view showing a structure of a discharge lamp 700 of Embodiment 5.

For the purpose of reducing the contact resistance between the external lead 30 and the Mo foil 24, as shown in FIG. 18, a discharge lamp 700 can have the following structure. Instead of the Mo foil 24 integrally formed with the external lead 30, the Mo foil 24 of the discharge lamp 700 has a junction 32 obtained by plane-welding the external lead 30 and the Mo foil 24. As in the discharge lamp 700, in the case where the end of the external lead 30 is planed and welded to the Mo foil 24, face contact can be achieved in contrast to substantially point contact in the prior art. Therefore, it is possible to reduce the contact resistance between the external lead 30 and the Mo foil 24. Furthermore, in the discharge lamp 700, the contact area of the junction 32 can be larger than that in the prior art, so that point welding can be performed in an increased number of times, and therefore this is preferable in view of the production process. In addition, the shape of the junction 32 can be smooth.

EMBODIMENT 6

Figure 19:
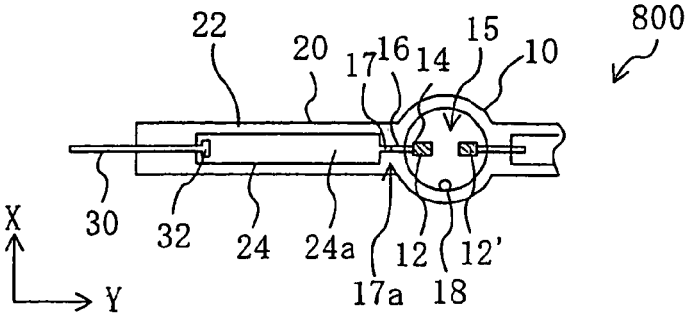
FIG. 19 is a schematic top view showing a structure of a discharge lamp 800 of Embodiment 6.

A discharge lamp 800 of Embodiment 6 of the present invention will be described with reference to FIG. 19. FIG. 19 is a schematic top view of a part of the discharge lamp 800 of this embodiment.

The discharge lamp 800 of this embodiment has a molybdenum rod (Mo rod) 17 extending from the Mo foil 24 to the luminous bulb 10 and connected to the electrode (W electrode) 12 by welding. The end face of the edge of the Mo rod 17 is joined to one end face of an electrode rod 16 of the W electrode 12. The Mo rod 17 can be joined to the electrode rod 16 by, for example, laser welding, or may be joined by electric welding.

When the Mo rod 17 extending from the Mo foil 24 is connected to the W electrode 12, the connection portion 17*a* can be more smooth than in direct connection of the Mo foil 24 and the W electrode 12. Therefore, this makes it difficult for cracks to occur in the glass portion 22 in the periphery of the connection portion 17*a* between the Mo foil 24 and the electrode 12, so that the strength of the discharge lamp can be improved. When at least one of the pair of the Mo foils 24 has the Mo rod 17, the strength of the discharge lamp can be improved over the prior art. However, it is more preferable that both of the Mo foils 24 have the rods 17.

In this embodiment, the Mo foil 24 is plane-welded to the external lead 30, but it is possible to use the Mo foil 24 integrally formed with the external lead 30. More specifically, it is form integrally the Mo foil 24, the Mo rod 17 extending from the Mo foil 24, and the external lead 30. Furthermore, the external lead 30 can be simply welded to the Mo foil 24 having the Mo rod 17.

EMBODIMENT 7

Figure 20:
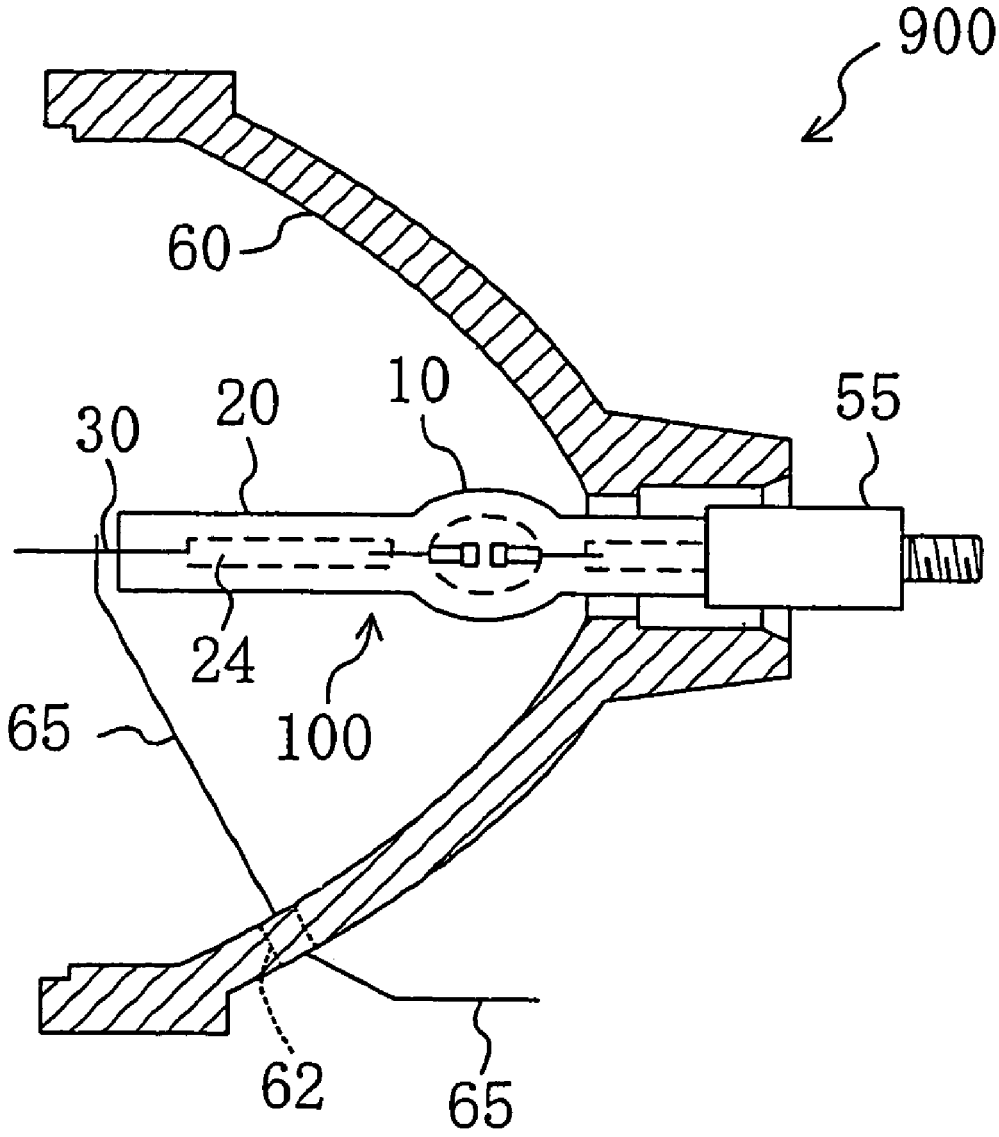
FIG. 20 is a schematic top view showing a structure of a discharge lamp 900 of Embodiment 7.
Figure 21A:
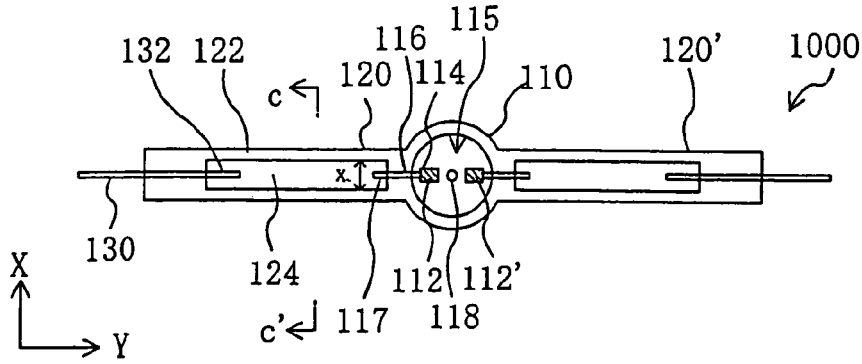
FIG. 21A PRIOR ART
FIG. 21A is a schematic top view showing a structure of a conventional discharge lamp 1000.
Figure 21B:
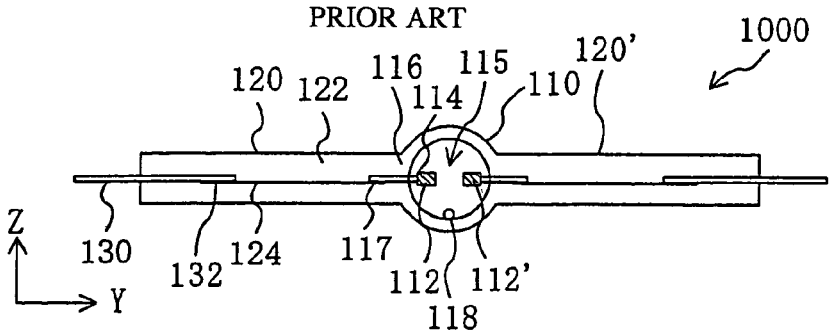
FIG. 21B PRIOR ART
FIG. 21B is a schematic side view showing a structure of a discharge lamp 1000.
Figure 21C:
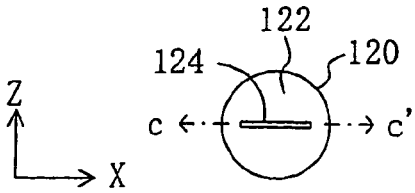
FIG. 21C PRIOR ART
FIG. 21C is a cross-sectional view taken along line c–c' of FIG. 21A.
Figure 22A:
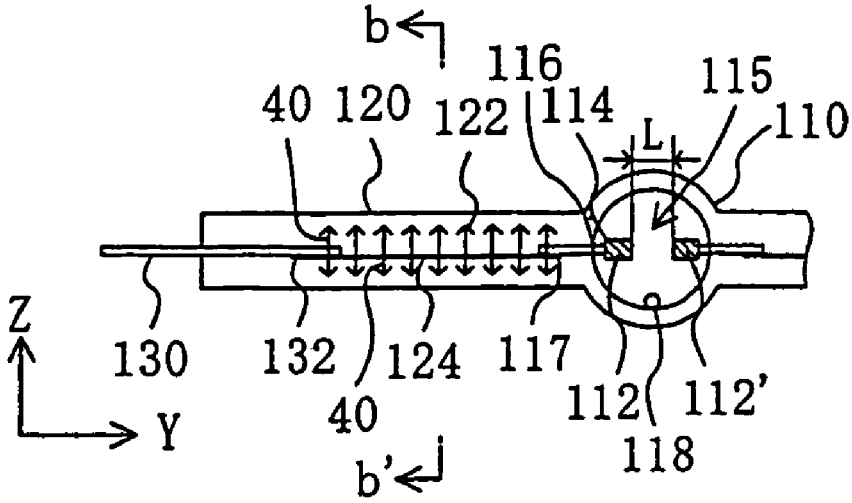
PRIOR ART FIG. 22A
FIGS. 22A and 22B are views for illustrating the problems of the conventional discharge lamp 1000.
Figure 22B:
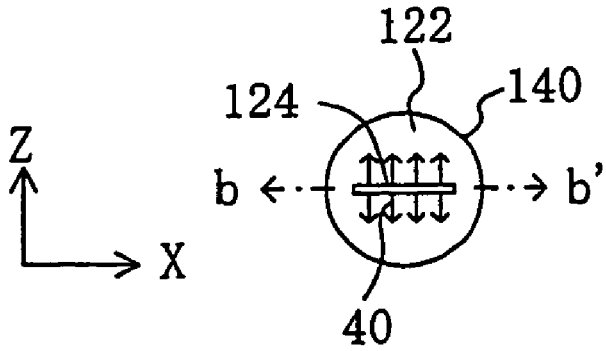
PRIOR ART FIG. 22B

The discharge lamps of Embodiments 1 to 6 can be formed into lamp units in combination with reflecting mirrors. FIG. 20 is a schematic cross-sectional view of a lamp unit 900 including the discharge lamp 100 of Embodiment 1.

The lamp unit 900 includes the discharge lamp 100 including a substantially spherical luminous portion 10 and a pair of sealing portions 20 and a reflecting mirror 60 for reflecting light emitted from the discharge lamp 100. The discharge lamp 100 is only illustrative, and any one of the discharge lamps of the above embodiments can be used. The lamp unit 900 may further include a lamp house holding the reflecting mirror 60.

The reflecting mirror 60 is designed to reflect the radiated light from the discharge lamp 100 so that the light becomes, for example, a parallel luminous flux, a condensed luminous flux converged on a predetermined small area, or a divergent luminous flux equal to that emitted from a predetermined small area. As the reflecting mirror 60, a parabolic reflector or an ellipsoidal mirror can be used, for example.

In this embodiment, a lamp base 55 is attached to one of the sealing portion 20 of the discharge lamp 100, and the external lead extending from the sealing portion 20 and the lamp base are electrically connected. The sealing portion 20 attached with the lamp base 55 is adhered to the reflecting mirror 60, for example, with an inorganic adhesive (e.g., cement) so that they are integrated. A lead wire 65 is electrically connected to the external lead 30 of the sealing portion 20 positioned on the front opening side. The lead wire 65 extends from the external lead 30 to the outside of the reflecting mirror 60 through an opening for a lead wire 65 of the reflecting mirror 60. For example, a front glass can be attached to the front opening of the reflecting mirror 60.

Such a lamp unit can be attached to an image projection apparatus such as a projector employing liquid crystal or DMD, and is used as the light source for the image projection apparatus. The discharge lamp and the lamp unit of the above embodiments can be used, not only as the light source for image projection apparatuses, but also as a light source for ultraviolet steppers, or a light source for an athletic meeting stadium, a light source for headlights of automobiles or the like.

OTHER EMBODIMEMTS

In the above embodiments, mercury lamps employing mercury as the luminous material have been described as an example of the discharge lamp of the present invention. However, the present invention can apply to any discharge lamps in which the airtightness of the luminous bulb is maintained by the sealing portion (seal portion). For example, the present invention can apply to discharge lamp-enclosing a metal halide such as a metal halide lamp.

In the above embodiments, the mercury vapor pressure is about 20 MPa (in the case of so-called ultra high pressure mercury lamps). However, the present invention can apply to high-pressure mercury lamps in which the mercury vapor pressure is about 1 MPa, or low-pressure mercury lamps in which the mercury vapor pressure is about 1 kPa. Furthermore, the gap (arc length) between the pair of electrodes 12 and 12' can be short, or can be longer than that. The discharge lamps of the above embodiments can be used by any lighting method, either alternating current lighting or direct current lighting.

The structures of the above embodiments can be mutually used. For example, it is preferable to combine any one of the structures Of Embodiments 1 to 4 with either one of structures of Embodiments 5 and 6 for improvement of the lifetime of the discharge lamp.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A discharge lamp comprising:

a luminous bulb in which a luminous material is enclosed and a pair of electrodes are opposed in the luminous bulb; and a pair of sealing portions for sealing a pair of metal foils electrically connected to the pair of electrodes, respectively;

wherein at least one of the pair of metal foils has a twist structure having a twisted portion of which an angle is not less than 30° and not more than 90° with respect to a portion on the luminous bulb side of the metal foil.

2. The discharge lamp of claim 1, wherein each of the pair of metal foils is directly attached to a glass portion extending from the luminous bulb, and each of the pair of metal foils is a molybdenum foil.

3. The discharge lamp of claim 1 or 2, wherein each of the pair of sealing portion has a shrink seal structure.

4. The discharge lamp of claim 1 or 2, wherein the luminous material comprises at least mercury.

5. A lamp unit comprising the discharge lamp of claim 1 or 2 and a reflecting mirror for reflecting light emitted from the discharge lamp.

* * * * *